US012377340B1

(12) United States Patent
Schenck

(10) Patent No.: US 12,377,340 B1
(45) Date of Patent: Aug. 5, 2025

(54) SNOW SLIDING DEVICES AND METHODS OF MANUFACTURE THEREOF

(71) Applicant: Renoun, LLC, Burlington, VT (US)

(72) Inventor: Cyrus K. Schenck, Burlington, VT (US)

(73) Assignee: Renoun, LLC, Burlington, VT (US)

( * ) Notice: Subject to any disclaimer, the term of this patent is extended or adjusted under 35 U.S.C. 154(b) by 0 days.

(21) Appl. No.: 19/043,853

(22) Filed: Feb. 3, 2025

(51) Int. Cl.
*A63C 5/03* (2006.01)
*A63C 5/12* (2006.01)

(52) U.S. Cl.
CPC . *A63C 5/03* (2013.01); *A63C 5/12* (2013.01)

(58) Field of Classification Search
CPC .. A63C 5/03; A63C 5/12; A63C 5/122; A63C 5/126; A63C 5/056; A63C 5/124
See application file for complete search history.

(56) References Cited

U.S. PATENT DOCUMENTS 5,399,293 A * 3/1995 Nunez ..... B01F 23/43 366/279
5,915,716 A * 6/1999 Artus ..... A63C 5/075 280/809
6,851,699 B2 * 2/2005 DeRocco ..... A63C 5/126 280/608
9,539,488 B2 * 1/2017 Schenck ..... A63C 5/126
10,774,544 B2 * 9/2020 Hayes ..... E04F 15/102
11,478,691 B2 * 10/2022 Schenck ..... B29C 65/562
2016/0339326 A1 * 11/2016 Postaire ..... A63C 5/03

FOREIGN PATENT DOCUMENTS

CN 116396537 A * 7/2023
CN 117951931 A * 4/2024 ..... G06F 30/23
JP 2019194278 A * 11/2019 ..... C08K 3/013

OTHER PUBLICATIONS

CN-117951931-A English Translation (Year: 2024).*
JP-2019194278-A English Translation (Year: 2019).*
CN-116396537-A English Translation (Year: 2023).*

* cited by examiner

*Primary Examiner* — James A Shriver, II
*Assistant Examiner* — Michael T. Walsh
(74) *Attorney, Agent, or Firm* — Caldwell Intellectual Property Law

(57) ABSTRACT

A snow sliding device include a core, a plurality of securing elements including a base with a sliding surface, a top surface, and at least a sidewall, and one or more constituents, wherein at least a constituent of the one or more constituents transitions between a first composition at a first position and a second composition at a second position, wherein the first composition includes a first proportion of a non-Newtonian material mixed with a second proportion of Newtonian material, the second composition includes a third proportion of the non-Newtonian material mixed with a fourth proportion of Newtonian material, and the first proportion is different from the third proportion.

22 Claims, 11 Drawing Sheets

SNOW SLIDING DEVICES AND METHODS OF MANUFACTURE THEREOF

FIELD OF THE INVENTION

The present invention generally relates to the field of sport equipment. In particular, the present invention is directed to snow sliding devices and methods of their manufacture.

BACKGROUND

Snow sliding devices such as skis and snowboards are constructed from multiple components and materials in order to meet several mechanical requirements and design goals, such as giving a user an ability to maneuver the devices over snowy surfaces, minimizing vibration or "chatter" of the devices as they slide, as well as striking a balance between rigidity, flexibility, and durability of the devices. Unfortunately, existing methods for constructing snow sliding devices do not have an effective way to account for the variability of conditions under which such devices may be operated, or to limit vibration satisfactorily under more challenging conditions.

SUMMARY OF THE DISCLOSURE

In an aspect, a first snow sliding device is described. First snow sliding device includes a core and a plurality of securing elements including a base with a sliding surface, a top surface, and at least a sidewall. First snow sliding device further includes one or more constituents, wherein at least a constituent of the one or more constituents transitions between a first composition at a first position and a second composition at a second position, the first composition includes a first proportion of a non-Newtonian material mixed with a second proportion of Newtonian material, the second composition includes a third proportion of the non-Newtonian material mixed with a fourth proportion of Newtonian material, and the first proportion is different from the third proportion.

In another aspect, a second snow sliding device is described. Second snow sliding device includes an elongated core with a longitudinal axis and a plurality of flanks disposed across the longitudinal axis, wherein a first flank of the plurality of flanks includes at least a non-Newtonian material and a first composition, a second flank of the plurality of flanks includes the at least a non-Newtonian material and a second composition, and the first composition is different from the second composition. Second snow sliding device further includes a plurality of securing elements including a base with a sliding surface, a top surface, and at least a sidewall.

In another aspect, a first method for manufacturing first snow sliding device is described. First method includes forming core and providing plurality of securing elements, wherein the plurality of elements includes base with sliding surface, top surface, and at least a sidewall. Method further includes providing one or more constituents, wherein at least a constituent of the one or more constituents transitions between first composition at first position and second composition at second position, the first composition includes first proportion of non-Newtonian material mixed with second proportion of Newtonian material, the second composition includes third proportion of the non-Newtonian material mixed with fourth proportion of Newtonian material, and the first proportion is different from the third proportion.

First method further includes combining plurality of securing elements and one or more constituents to core.

In another aspect, a second method for manufacturing second snow sliding device is described. Second method includes forming elongated core including longitudinal axis and plurality of flanks disposed across the longitudinal axis, wherein first flank of the plurality of flanks includes at least a non-Newtonian material and first composition, second flank of the plurality of flanks includes the at least a non-Newtonian material and second composition, and the first composition is different from the second composition. Second method further includes providing plurality of securing elements, wherein the plurality of securing elements includes base with sliding surface, top surface, and at least a sidewall. Second method further includes combining plurality of securing elements to elongated core.

These and other aspects and features of nonlimiting embodiments of the present invention will become apparent to those skilled in the art upon review of the following description of specific nonlimiting embodiments of the invention in conjunction with the accompanying drawings.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein.

The drawings are not necessarily to scale and may be illustrated by phantom lines, diagrammatic representations and fragmentary views. In certain instances, details that are not necessary for an understanding of the embodiments or that render other details difficult to perceive may have been omitted.

DETAILED DESCRIPTION

At a high level, aspects of the present disclosure are directed to snow sliding devices such as skis and snowboards and related methods of their manufacture. Snow sliding device includes a core and a plurality of securing elements including a base with a sliding surface, a top surface, and at least a sidewall. Snow sliding device also includes a non-uniform composition of at least a non-Newtonian material. In one or more embodiments, snow sliding device may include one or more constituents, wherein at least a constituent of the one or more constituents may transition between a first composition at a first position and a second composition at a second position. In one or more embodiments, snow sliding device may include an elongated core with a longitudinal axis and a plurality of flanks disposed across the longitudinal axis, wherein a first flank of plurality of flanks may include a first composition, a second flank of the plurality of flanks may include a second composition, and the first composition is different from the second composition.

Aspects of the present disclosure can be used to create better-performing snow sliding devices with reduced vibration and superior durability. For purposes of description herein, relating terms, including "top," "bottom," "left," "right," "front," "back," "vertical," "horizontal," "tip," "tail," "toe," "heel," and derivatives thereof are defined from the perspective of a hypothetical user standing on top of snow sliding device during its use.

Figure 1:
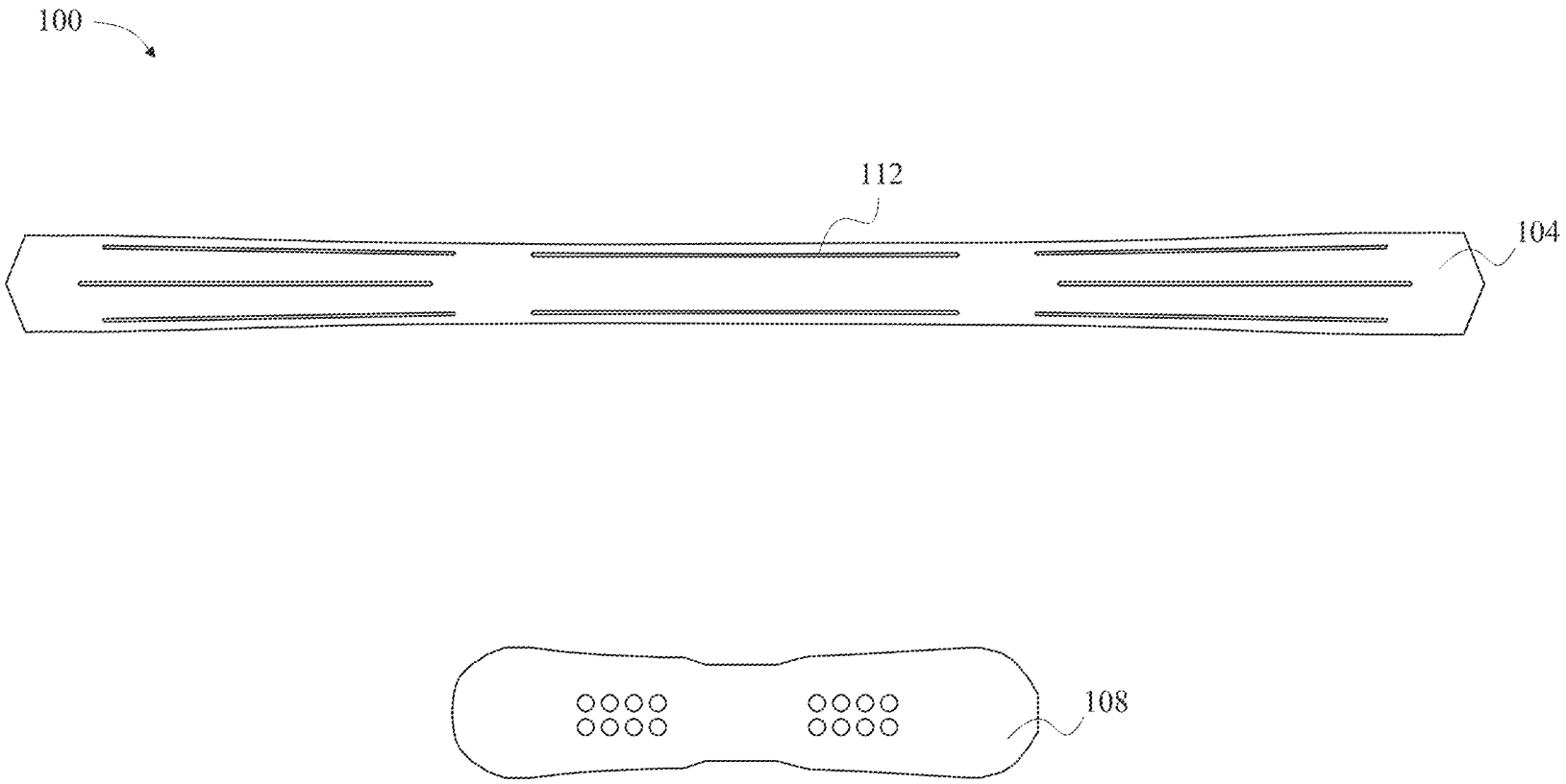
FIG. 1 is a schematic illustration of exemplary embodiments of a snow sliding device.

Referring now to FIG. 1, exemplary embodiments of a snow sliding device 100 are illustrated. Snow sliding device 100 may include without limitation cross-country ski, skate ski, downhill or "alpine" ski of any type, telemark ski, and snowboard. For the purposes of this disclosure, a "snow sliding device" is a recreational device used by a person to traverse a snowy surface by sliding on its substantially flat bottom surface. For the purposes of this disclosure, a snowy surface is a surface formed by a deposition of ice crystals and agglomerations of ice crystals on a solid substrate such as ground, frozen water, human-made surfaces, and/or the like. A snowy surface may be formed by natural precipitation of snow, sleet, freezing rain, and other precipitation depositing frozen water or freezing water in any forms or combinations. Snow may be deposited using artificial means, such as snow-producing machines commonly used on alpine and cross-country ski trails. A snowy surface may have crusts or layers of ice, compacted snow, fluffy or powered snow, nodules of ice, snow that has melted and refrozen one or more times to form granules of ice, and/or the like. In some cases, a snowy surface may be groomed. For the purposes of this disclosure, "grooming" is a process performed by humans, machines, and/or combinations thereof to make a snowy surface more suitable for one or more forms of snow sliding recreation or the like. Grooming may include, without limitation, grading or leveling, compacting, raking, forming into topographical features such as moguls, ramps, jumps, half-pipes, and/or the like. In some cases, a snowy surface may be ungroomed or natural. For the purposes of this disclosure, an "ungroomed" or "natural" surface is a surface formed solely by deposition of precipitation, by natural processes affecting deposited precipitation, and/or by passage of snow sliding devices when the surface is used for its intended recreational purposes. Natural processes affecting deposited precipitation may include, for instance, drifting due to wind, melting and thawing, avalanches, and/or or the like. In some cases, a snowy surface may also be formed by a grooming-type process that emulates the conditions of a natural surface. A snowy surface may also include artificial surfaces created to imitate one or more characteristics of snowy surfaces as described above, using a combination of manufactured elements including textiles, polymers, and the like. For the purposes of this disclosure, a "substantially flat" surface is a surface that can be locally treated as flat despite having an extended curvature. As a nonlimiting example, a hilly skiing resort may have snowy surface with a noticeable curvature, yet the small portion of the snowy surface with which a snow sliding device is in contact may still be treated as substantially flat. As another nonlimiting example, at least part of a ski may possess some form of curvature, such as without limitation a camber/reversed camber design, a rocker design, a camber-rocker hybrid design, or the like, yet the portion of the ski in contact with snowy surface during its use may still be treated as substantially flat.

With continued reference to FIG. 1, in one or more embodiments, snow sliding device 100 may include a ski 104. A ski typically contains three sections: a tip section, a middle section, and a tail section. A ski may be characterized by design parameters such as without limitation ski length, longitudinal flex (i.e., the flexibility of a ski from its tip to its tail), waist width, sidecut (i.e., the shape cut out of the side of the ski), curvature (e.g., camber, rocker, camber/rocker hybrid, shovel at the tip, and/or the like), and torsional rigidity, among others. In one or more embodiments, snow sliding device 100 may include a snowboard 108. A snowboard typically includes four sections: a nose, a tail, a toe side, and a heel side. A snowboard may follow design parameters similar to those applicable to a ski, as described above. Shapes of a snowboard may include shapes such as without limitation twin tip, directional twin, directional, directional powder, volume shift, and/or the like. Profiles of a snowboard may include without limitation camber, camrock, hybrid camber, triple base (3BT), and/or the like. Additionally, and/or alternatively, a snowboard may include a sidecut such as radial sidecut and multi-radial sidecut, among others. In some cases, a snowboard may include additional design features such as traction enhancement and pressure manipulation, among others.

With continued reference to FIG. 1, in one or more embodiments, snow sliding device 100, such as a ski may further include at least a first void 112 configured to damp at least an antinode of a vibration. Passage over a snowy surface with a particular granularity, degree of slippage, ice content, compactness, and/or the like, may result in a particular frequency of vibration activated by the snowy surface. Vibration induced by a particular snowy surface may be calculated, for instance using a mathematical relation between surface granularity, or another surface attribute, and frequency of vibration. Vibration induced by a particular snowy surface may be measured. As nonlimiting examples, video such as slow-motion video, or accelerometer data from one or more accelerometers attached to a snow sliding device, may be analyzed to determine vibration induced by a snowy surface. Vibration induced by a snowy surface may have primary or secondary waveform elements. In one or more embodiments, data such as accelerometer data may be subjected to frequency analysis, such as fast Fourier transform (FFT) analysis, to determine at least a dominant waveform frequency or a plurality of significant waveform frequencies. Snow sliding device 100 may then be subjected to vibration at one or more frequencies thus determined to be induced by the snowy surface, and at least a first void 112 may be selected to damp each frequency of the induced frequencies, for instance by detecting various antinodes and creating voids of greater volume per unit length at each antinode. Decisions on how and where to place at least a first void 112 may be consistent with details disclosed in U.S. patent application Ser. No. 16/507,229, filed on Jul. 10, 2019, and entitled "SNOW SLIDING DEVICE INCORPORATING MATERIAL HAVING SHEAR-RATE DEPENDENT SHEAR RESISTANCE, AND METHODS FOR ITS MANUFACTURE," the entirety of which is incorporated herein by reference.

Figure 2A:
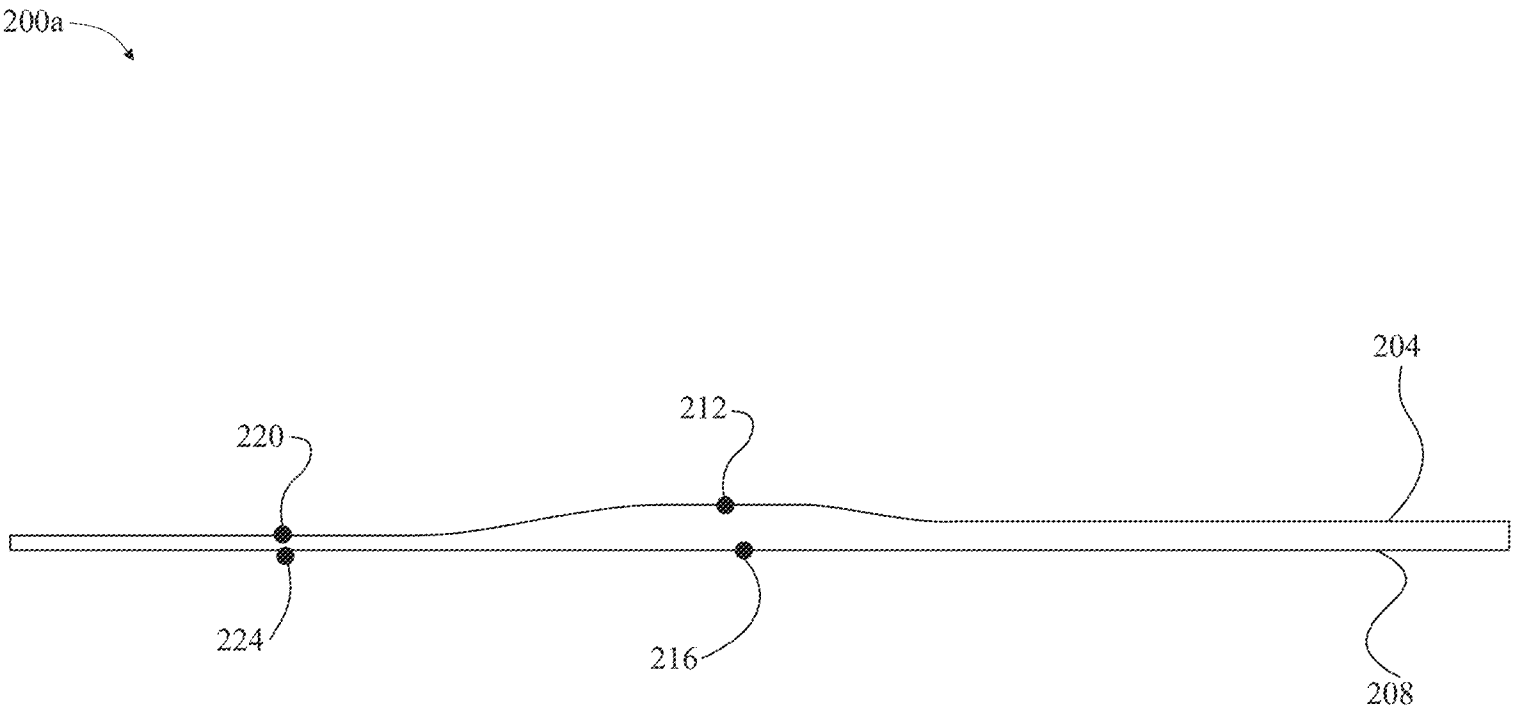
FIGS. 2A-C are schematic illustrations of exemplary embodiments of a core of a first snow sliding device, including at least a channel and at least an insert.
Figure 2B:
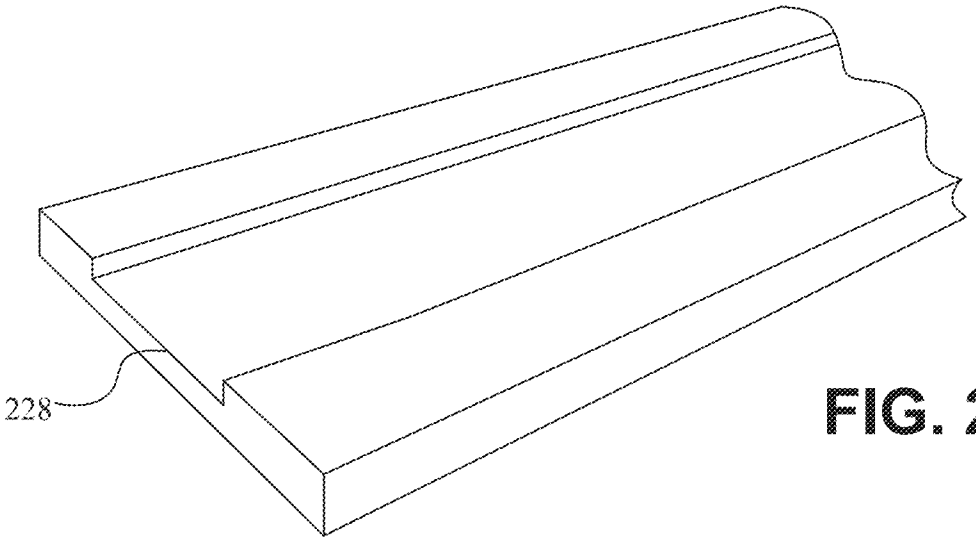
Figure 2C:
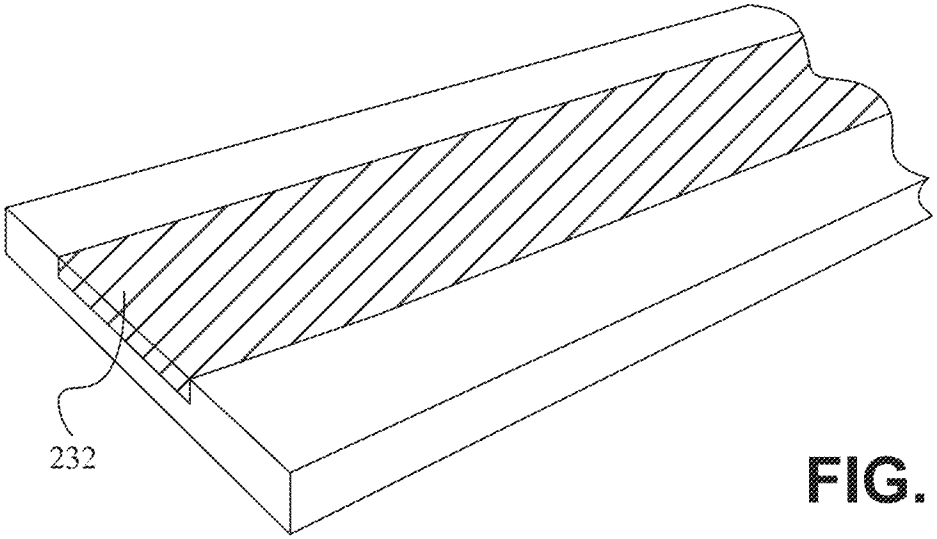

Referring now to FIGS. 2A-C, a first snow sliding device 100 is described. First snow sliding device 100 includes a core, exemplary embodiments 200*a-c* of which are illustrated. For the purposes of this disclosure, a "core" is a structural element primarily located at the interior of an object in order to support its overall integrity. Core 200*a-c* may be composed of any suitable material or combination of materials, including without limitation wood such as maple, ash, beech, poplar, okoume, or other wood, plywood, fiberglass, laminated fiberglass, metal such as steel, titanium, aluminum, combinations of metals, or alloys of metals, composite honeycomb, foam, resin, carbon fiber, graphene, polyurethane, polyethylene, epoxy, or any other material combination usable to provide desired material properties including stiffness and flexibility to the core 200*a-c*. Core 200*a-c* may include an upper surface 204 and lower surface 208, which represent surfaces nearer to, respectively, a sliding surface and a top surface on which a user stands, as described below.

With continued reference to FIGS. 2A-C, in one or more embodiments, core 200*a-c* may have a non-uniform thickness across a plurality of locations in order to satisfy different design requirements across the plurality of locations. Specifically, as shown in FIG. 2A, core 200*a* may include a first thickness and a second thickness. First thickness may define a first vertical distance from at least a first point 212 on upper surface to its corresponding at least a first point 216 on lower surface. Accordingly, second thickness may define a second vertical distance from at least a second point 220 on upper surface 204 to its corresponding at least a second point 224 on lower surface 208. Designation between first thickness and second thickness may be arbitrary. In some cases, second thickness may be smaller than first thickness. As a nonlimiting example, first thickness may be a thickness at or near a point where a user stands on first snow sliding device 100, which may be a point where one or more fastening mechanisms are attached, as described below. Second thickness may be a thickness of a forward section of core 200*a*, where a thinner construction for first snow sliding device 100 is desired to permit some degree of flexibility. Core 200*a* may be further shaped to include a third thickness, which may, for instance, be a thickness of a rear section of the core 200*a*. Third thickness may be larger or smaller than first thickness and/or second thickness. As a nonlimiting example, traversing core 200*a* from front to back, a front section of second thickness may widen to a middle section of first thickness and then taper down to a rear section of third thickness, which is slightly thicker than the front section. First, second, and/or third thickness may be in the range of 10 mm and 30 mm.

With continued reference to FIGS. 2A-C, in one or more embodiments, core 200*a-c* may be formed using molding, such as injection molding. As a nonlimiting example, a mold having the shape of core 200*a-c* may be prepared and filled with a liquified resin or metal, or a froth that is then cured or allowed to harden into resin, metal, or foam. Curing may be performed by modifications of temperature of contents within mold, by passage of time, by exposure to additional chemicals, by exposure to air, and by irradiation including but not limited to irradiation with ultraviolet radiation, among others. Core 200*a-c* may then be removed or extracted from mold. Shaping core 200*a-c* may be accomplished by a shape of mold; that is, upon extraction of the core 200*a-c* from the mold, core 200*a-c* may already have first and second thicknesses. Core 200*a-c* may be subjected to additional shaping after extraction, for instance by machining, shaving, or otherwise removing material to further shape the core 200*a-c*; additional steps may alternatively include addition of material to core 200*a-c* by additive means such as impregnation of the core 200*a-c* with one or more materials, sealing of an exterior surface of the core 200*a-c*, lamination of one or more exterior layers to the core 200*a-c*, and/or the like. Additional details will be described below in this disclosure.

With continued reference to FIGS. 2A-C, in one or more embodiments, one or more elements of first snow sliding device 100, such as core 200*a-c*, may be formed by subtractive manufacturing. For the purposes of this disclosure, "subtractive manufacturing" is a process that creates a part or product by removal of excess material from an already existing object. In some cases, subtractive manufacturing may be performed manually, for instance by cutting, sawing, or rasping material. In some cases, subtractive manufacturing may be mechanized, i.e., performed using a device that restricts material-removal tools to one or more specific degrees of freedom, such as sliding or rotary motions. Nonlimiting examples of mechanized subtractive manufacturing may include a lathe, a plane or knife constrained to a track, or a saw that slides or has material slid past on a track. A further nonlimiting example of mechanized subtractive manufacturing includes a milling machine tool, which may include one or more rotary tools for material removal and one or more slides or the like for moving the one or more rotary tools relative to an object from which a portion of material is to be removed. In some cases, subtractive manufacturing may be performed using an automated manufacturing device, which may include any device that is controlled by an automated process. As nonlimiting examples, automated manufacturing device may be controlled by a logic circuit including one or more logic gates, by a finite state machine, a processor using Vonn Neumann or Harvard architecture with reference to a digital storage memory, a computer or computing device, a microprocessor, an analog circuit responding to one or more feedback systems, a mechanized automated system, a control system, or the like. As another nonlimiting example, automated manufacturing device may include a computer numerical control (CNC) machine.

With continued reference to FIGS. 2A-C, in one or more embodiments, a core blank may be provided, which may be composed of any material or combination of materials suitable for construction of core 200*a-c* as described above. A core blank may be initially formed by cutting or machining the core blank from a larger block of material. As a nonlimiting example, a machine tool such as a CNC machine or hand-operated machine tool including one or more cutting or material-removal tools, which may be powered or static tools (including without limitation a drag-knife), may be used or operated to cut out an exterior outline of core 200*a-c*. A worker may cut or saw a core blank from a block of material. A core blank or block of material may be formed by other processes including without limitation molding, additive manufacture, subtractive manufacturing, or any other process useable to produce a block of material. Core 200*a-c* may be shaped from a core blank using any subtractive process described above, including without limitation sanding or other material removal in a CNC machine.

With continued reference to FIGS. 2A-C, in one or more embodiments, one or more elements of first snow sliding device 100, such as core 200*a-c*, may be formed by an additive manufacturing process. For the purposes of this disclosure, an "additive manufacturing process" is a process of forming a part or product by successive deposition of layers or other quanta of material. Additive processes may include, without limitation, stereolithography (SLA), rapid prototyping, and/or "3D printing" of any description, powder deposition and fixing processes such as deposition of power and binding, laser sintering and the like, lamination of successive layers of material that is then cured or allowed to dry, controlled deposition of molten material that cures or dries, or any other process involving successive deposition of material. Layers may be deposited on top of a base or around core 200*a-c*. Additive manufacturing may be manual, mechanized, or automated as described above, including without limitation additive manufacturing using a rapid prototyping device controlled by a processor-based system such as a computer or microcontroller.

With continued reference to FIGS. 2A-C, in one or more embodiments, core 200*a-c* may be initially formed as a hollow body, for instance using blow-molding or additive manufacture, and then filled with additional material, including without limitation resin, gel, foam, liquid, epoxy, or other material. In one or more embodiments, as shown in FIG. 2B, core 200*b* may include at least a channel 228. For the purposes of this disclosure, a "channel" is a hollow, elongated cavity that is either fully encased in an object or partially embedded in an object with one or more sides exposed toward the outside. In some cases, and as shown in FIG. 2C, at least a channel 228 may be filled with at least an insert 232. Additional details will be provided below.

Figure 3:
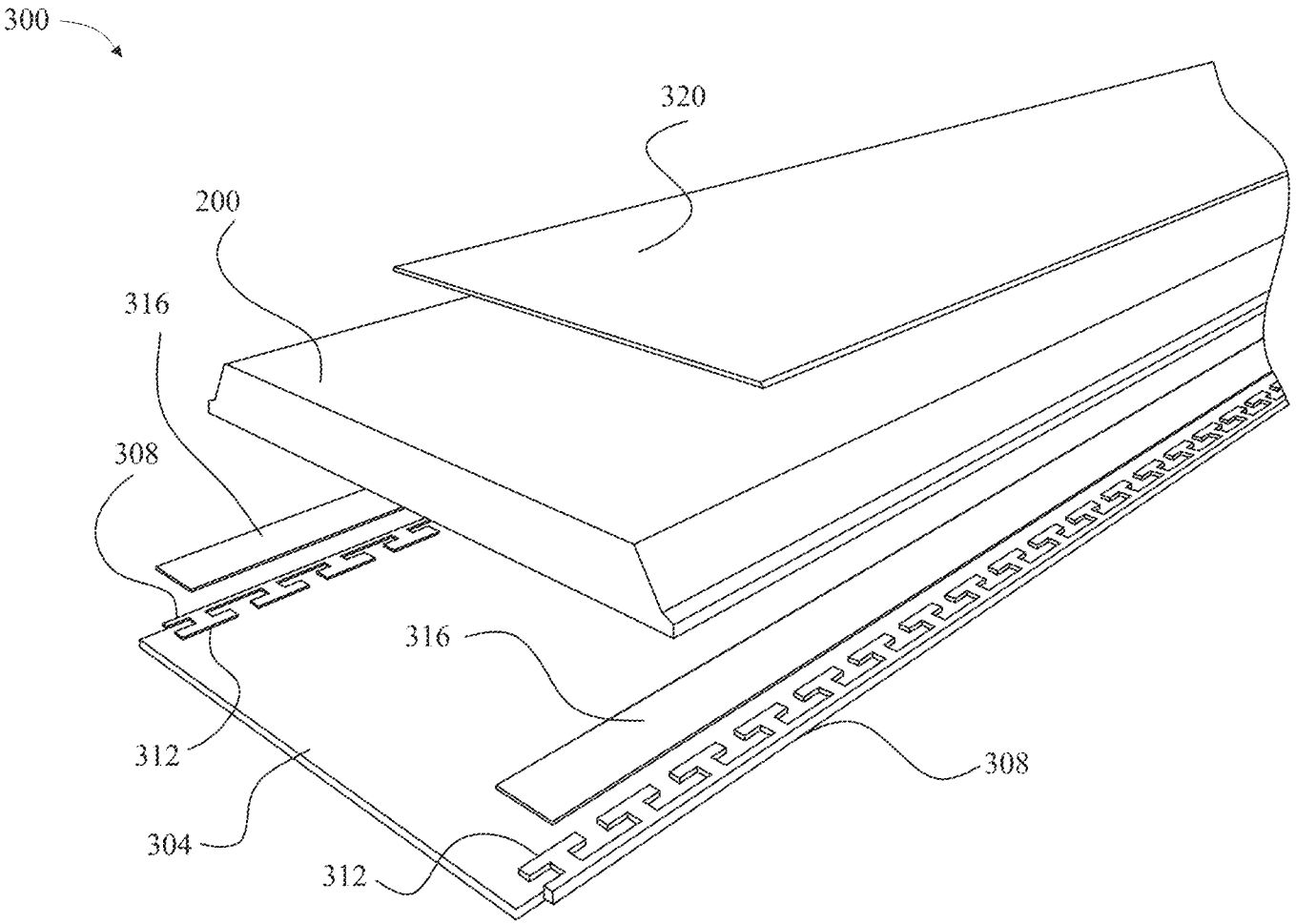
FIG. 3 is a schematic illustration of an exemplary embodiment of a portion of the first snow sliding device and a plurality of securing elements therein in an exploded view.

Referring now to FIG. 3, an exemplary embodiment 300 of a portion of first snow sliding device 100 is illustrated to reveal detailed structures therein. First snow sliding device 100 includes a plurality of securing elements. For the purposes of this disclosure, a "securing element" is an element attached directly or indirectly to core 200*a-c* in order to create an overall shape and/or impart necessary functions of first snow sliding device 100. Plurality of securing elements includes a base 304 comprising a sliding surface, as described above. For the purposes of this disclosure, a "base" is a flat or substantially flat layer located at the bottom of first snow sliding device 100 and having a lower surface that contacts snowy surface when first snow sliding device 100 is in use. Base 304 may be constructed of any material or materials suitable for sliding over snowy surface, including without limitation porous, plastic material saturated with a wax to produce a fast-sliding, low friction surface. Base 304 may be manufactured by any suitable process described above, including without limitation, by cutting or otherwise subtractive manufacturing base 304 from a sheet or block of material. In one or more embodiments, base 304 may be a portion of core 200*a-c*; that is, base 304 and core 200*a-c* may form a monolithic whole, of which the base 304 forms a lower portion. In most cases, sliding surface may be configured to be capable of sliding on a snowy surface with low friction. In some cases, sliding surface may also include higher-friction zones or elements to grip a snowy surface and propel snow sliding device 100 over the snowy surface.

With continued reference to FIG. 3, in one or more embodiments, plurality of securing elements may include at least a metal edge 308 attached to base 304. At least a metal edge 308 may provide snow sliding device 100 an edge with which a user can dig into a snowy surface to execute turns or otherwise control descent of slopes while on the snow sliding device 100. In some cases, at least a metal edge 308 may include at least a portion 312 overlapping a top surface of base 304. In some cases, at least a portion 312 may allow metal edge 308 to be adhered securely to base 304, permitting the metal edge 308 to endure significant shear strain without detaching from snow sliding device 100. Metal edge 308 may be formed using any manufacturing process, including without limitation machining. At least a metal edge 308 may include a metal edge disposed at each lateral side of base 304.

With continued reference to FIG. 3, in one or more embodiments, snow sliding device 100 may further include at least a buffering element 316 sandwiched between core 200*a-c* and at least a securing element of plurality of securing elements. For the purposes of this disclosure, a "buffering element" is an element capable of minimizing or counteracting undesired changes in an object. Buffering element 316 may be constructed using any suitable material to perform its function. In some cases, at least a buffering element 316 may be disposed on top of at least a portion of metal edge 308. In some cases, at least a buffering element 316 may include a strip of material that connects at least a portion thereof to the layer above it, permitting adhesion that is capable of withstanding shear stress. At least a buffering element 316 may be composed of any suitable material, including elastomeric material such as rubber. Additional details regarding buffering elements 316 will be provided below in this disclosure.

With continued reference to FIG. 3, first snow sliding device 100 includes a top surface 320. For the purposes of this disclosure, a "top surface" is a surface located at the top of first snow sliding device 100, opposite base 304, on which a user may stand when using the first snow sliding device 100. Top surface 320 may include a layer of material that forms a top surface of snow sliding device 300. Top surface 320 may include an integral portion of core 200*a-c*; for instance, top surface 320 and core 200*a-c* may be a monolithic whole, of which the top surface 320 makes up upper surface 204, or the surface opposite the sliding surface of base 304. Top surface 320 may be composed of any material or combination of material suitable for the composition of any element described herein. Top surface 320 may be manufactured from a sheet or strip or polymer material. Top surface 320 may act to seal one or more other elements against moisture, or to maintain a level of humidity of one or more other elements.

With continued reference to FIG. 3, first snow sliding device 100 may include a fastening mechanism, such as straps, fasteners, hooks, clips, and/or the like, to secure one or more feet of a user to snow sliding device 100. In some cases, such fastening mechanism may include bindings (not shown) that engage specialized or generic footwear. In some cases, bindings may be attached to top surface 320, for instance using screws or bolts fastened to core 200*a-c*.

Figure 4:
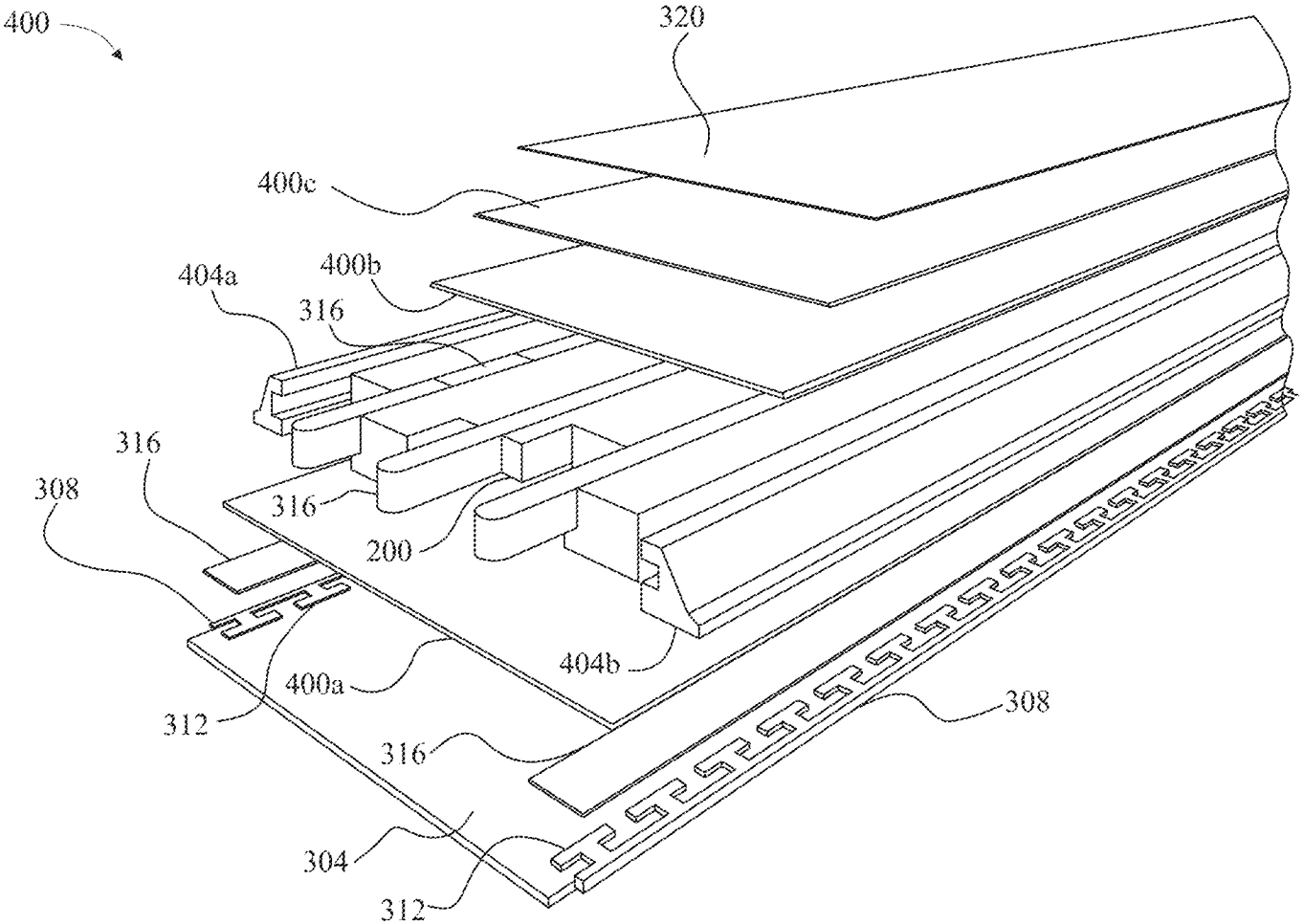
FIG. 4 is a schematic illustration of another exemplary embodiment of a portion of the first snow sliding device and additional elements therein in an exploded view.

Referring now to FIG. 4, an exemplary embodiment 400 of a portion of first snow sliding device 100 is shown to illustrate additional elements that may be provided as part of plurality of securing elements. Plurality of securing elements may further include at least a reinforcement element 400*a-c*. For the purposes of this disclosure, a "reinforcement element" is a structural or functional element specifically configured to protect and strengthen core 200*a-c* and/or one or more securing elements and improve the durability of first snow sliding device 100. Reinforcement element 400*a-c* may include any material or combination of materials suitable for constructing any elements described in this disclosure. In some cases, reinforcement element 400*a-c* may include a reinforcement layer. Specific material or materials may be used to impart certain desirable functions or properties to first snow sliding device 100. As a nonlimiting example, at least a reinforcement element 400*a-c* may include one or more layers of textile such as flannel to absorb epoxy or other material that adds weight or heft to first snow sliding device 100. As another nonlimiting example, reinforcement element 400*a-c* may include one or more layers of metals such as aluminum textured with another metal such as titanium, wherein the texturing may act to cause the one or more layers of metal to adhere more securely to other elements. As another nonlimiting example, reinforcement element 400*a-c* may include one or more layers of carbon fiber and/or one or more layers of graphene, among others. As another nonlimiting example, reinforcement element 400*a-c* may include one or more layers of elastomeric material to add flexibility or resilience to first snow sliding device 100. In some cases, a plurality of reinforcement elements 400*a-c* may be combined to add structural strength, shape, and/or resilience to snow sliding device 100.

With continued reference to FIG. 4, plurality of securing elements may include at least a sidewall 404*a-b*. For the purposes of this disclosure, a "sidewall" is a planar or curved element that covers at least one lateral side of first snow sliding device 100. In one or more embodiments, at least a side wall 404*a-b* may be placed adjacent to a lateral side of core 200*a-c*. In one or more embodiments, sidewall 404*a-b* may include a front wall, a back wall, a left wall, and/or or a right wall. In some cases, sidewall 404*a-b* may be flat or substantially flat. In some other cases, sidewall 404*a-b* may have a curvature visible to the naked eye. In some cases, there may be no clear demarcations between different "front," "back," "left," or "right" walls. As a nonlimiting example, sidewall 404*a-b* may be a continuous surface (i.e., a belt) that merges "front," "back," "left," or "right" walls altogether. At least a sidewall 404*a-b* may be constructed of any material suitable for constructing any element described in this disclosure. In some cases, sidewall 404*a-b* may be in a vertical position when first snow sliding device 100 is in use. In some other cases, sidewall 404*a-b* may be positioned at a tiled angle that deviates from 90 degrees. In one or more embodiments, at least a sidewall 404*a-b* may be constructed from a high-density polymer material, including without limitation acrylonitrile butadiene styrene (ABS). Alternatively, in one or more embodiments, snow sliding device 100 may be constructed without a sidewall. As a nonlimiting example, top surface 320 may be bent down around the sides of core 200*a-c* in a cap construction. As another nonlimiting example, sidewall 404*a-b* may be included as part of top surface 320. As another nonlimiting example, snow sliding device 100 may be constructed with a partial cap construction, such as without limitation having a sidewall 404*a-b* that covers part of a side of core 200*a-c*, and a cap that covers the remainder.

With continued reference to FIG. 4, in one or more embodiments, buffering element 316 may be strategically used to neutralize or counteract undesired expansions, shrinkages, or deformations of one or more elements within first snow sliding device 100 (e.g., an element containing a non-Newtonian material) that may be caused by extended use or changes in environmental conditions. In some cases, where an element becomes more rigid at certain temperatures and/or at certain shear rates, buffering element 316 may be constructed from materials including an elastic material that prevents separation of the element from its neighboring elements. In some cases, buffering element 316 may be used to add structural integrity at a portion of an element that contains a large amount of non-Newtonian material. As a nonlimiting example, a dilatant material may confer greater structural strength when subjected to high shear rates, but lesser structural strength at lower shear rates, as described below; accordingly, buffering element 316 including a rod of high-strength material such as metal or the like may strengthen a portion of snow sliding device 100 under such circumstances. As another nonlimiting example, when an element has a large coefficient of thermal expansion, buffering element 316 may include a material that compresses easily, absorbing the expansion of the element and preventing it from applying pressure on its neighboring elements, hence preserving the lamination within and the structural integrity of first snow sliding device 100. As nonlimiting examples, buffering element 316 may include at least a second void such as at least an air-filled gap, an easily compressible foam, or the like for such purposes. Similarly, buffering element 316 may also include a material, such as air or elastic foam, that readily expands to accommodate a shrinkage of an element with a high coefficient of negative thermal expansion.

Figure 5:
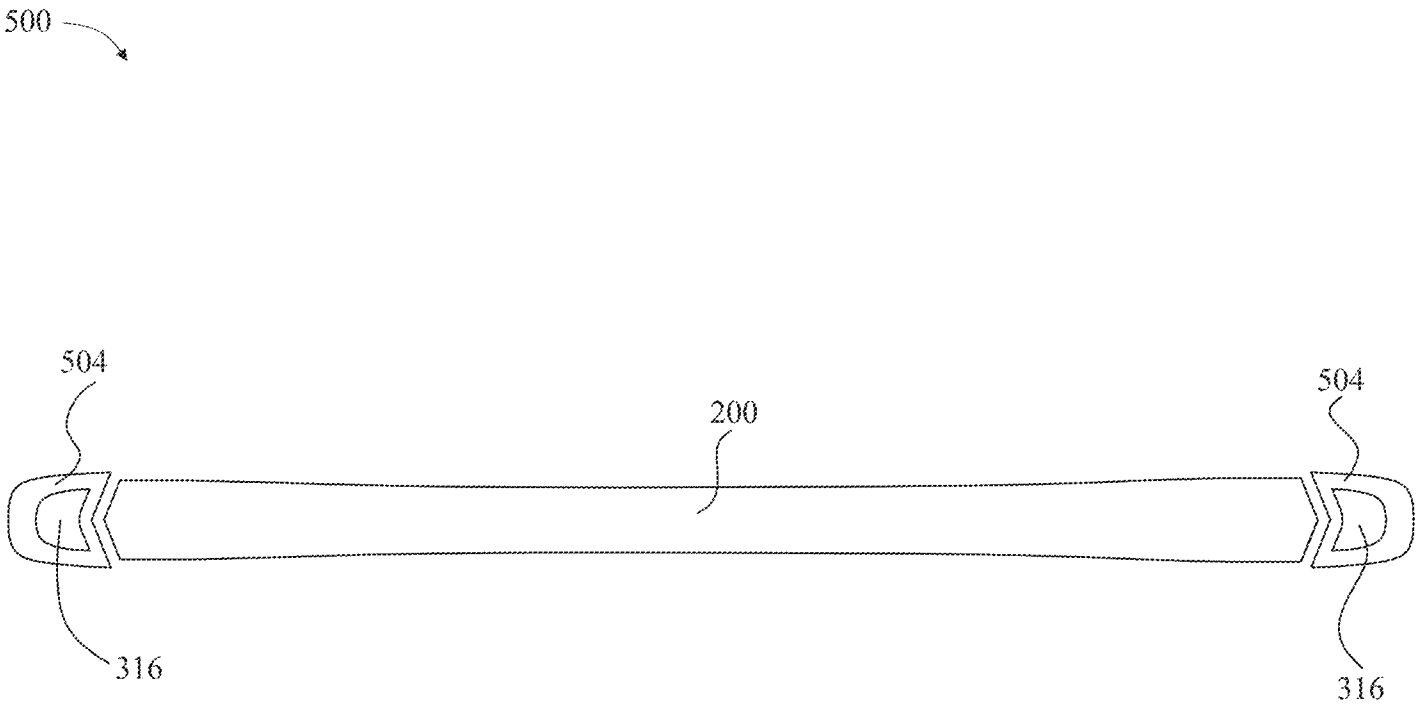
FIG. 5 is a schematic illustration of an exemplary embodiment of the first snow sliding device equipped with at least an end spacer.

Referring now to FIG. 5, an exemplary embodiment 500 of first snow sliding device 100 with at least an end spacer 504 is illustrated. In one or more embodiments, first snow sliding device 100 may further include at least an end spacer 504 located adjacent to a terminal surface of core 200*a-c*. For the purposes of this disclosure, an "end spacer" is a structural element placed at a terminal of an object to separate its interior and interior and to further stabilize the object. At least an end spacer 504 may be composed of any material or combination of materials suitable for the construction of sidewalls 404*a-b* or the like, including without limitation ABS. In some cases, at least an end spacer 504 may include at least a buffering element 316. As nonlimiting examples, buffering element 316 may be incorporated into end spacer 504 as filling. Additional details regarding end spacer may be consistent with details disclosed in U.S. patent application Ser. No. 16/507,229, filed on Jul. 10, 2019, and entitled "SNOW SLIDING DEVICE INCORPORATING MATERIAL HAVING SHEAR-RATE DEPENDENT SHEAR RESISTANCE, AND METHODS FOR ITS MANUFACTURE," the entirety of which is incorporated herein by reference.

Figure 6:
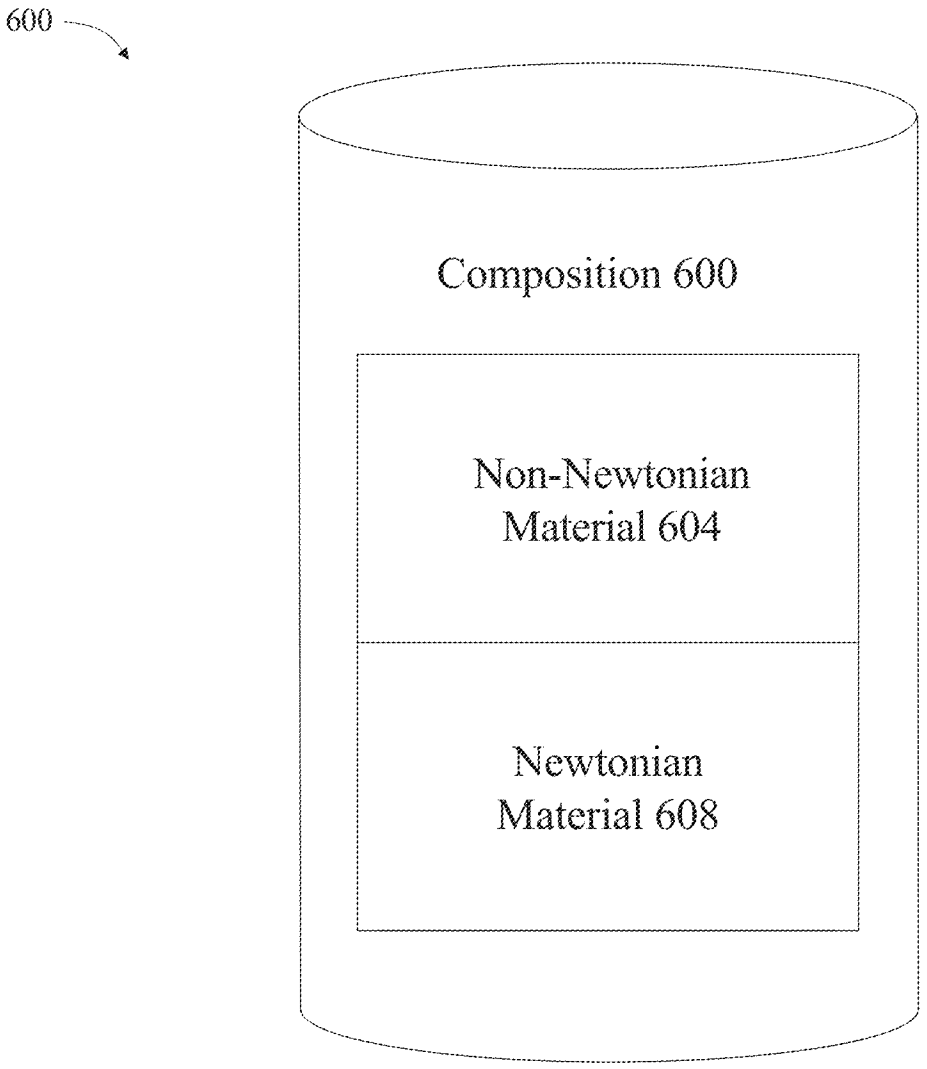
FIG. 6 is a box diagram of an exemplary embodiment of a composition for the first snow sliding device.

Referring now to FIG. 6, a box diagram of an exemplary embodiment of a composition 600 for first snow sliding device 100 is illustrated. First snow sliding device 100 includes at least a non-Newtonian material 604 and at least a Newtonian material 608. For the purposes of this disclosure, a "non-Newtonian material" is a type of material with some degree of fluidity whose rigidity, viscosity, and/or shear resistance changes with the applied shear rate or shear stress. "Non-Newtonian material" and "non-Newtonian fluid" may be used interchangeably throughout this disclosure. A non-Newtonian material may exhibit non-Newtonian properties in its native form; i.e., may not require breakage or exposure to excessive force before exhibiting non-Newtonian characteristics. In contrast, for the purposes of this disclosure, a "Newtonian material" is a type of material whose rigidity, viscosity, and/or shear resistance stays constant or essentially constant with respect to applied shear rate or shear stress. For the purposes of this disclosure, "rigidity" is a property of a material or structure that enables it to resist deformation when subjected to external forces. It quantifies a material's ability to maintain its shape and size under stress, with minimal deformation. Rigidity is often measured using moduli such as Young's modulus, shear modulus, and bulk modulus, which define the ratio of stress to strain for different types of deformation, as described in further detail below. For the purposes of this disclosure, "viscosity" is a measure of a fluid's resistance against flow or deformation. It quantifies the internal friction within a fluid and determines how easily the fluid moves under an applied force. In some cases, viscosity may include dynamic (absolute) viscosity, $\eta$, which is typically expressed in the unit of Pa·s or poise (1 poise=0.1 Pa·s). In some cases, viscosity may include kinematic viscosity, v, which is typically expressed in the unit of $m^2/s$ or stokes (1 stokes=$10^{-4}$ $m^2/s$). Viscosity may be expressed as a proportionality constant between shear stress and shear rate, as described below. For the purposes of this disclosure, "shear resistance" or "shear strength" is a property of a material to resist a structural change or deformation caused by one component of the material sliding or slipping over another component of the material. For the purposes of this disclosure, a "shear rate" is a measure of the rate at which adjacent layers of fluid move relative to each other, expressed in reciprocal seconds (s−1). It quantifies the velocity gradient in a fluid flow and indicates how quickly the velocity changes from one layer to the next. For the purposes of this disclosure, a "shear stress" is a measure of the force per unit area exerted by a fluid or solid layer as it moves parallel to an adjacent layer. Shear stress acts tangentially to a surface and results in its deformation, causing a material to change its shape.

With continued reference to FIG. 6, in one or more embodiments, either non-Newtonian material 604 or Newtonian material 608 may include intermixed materials of two or more types. In some cases, elastic and non-elastic flexible materials may be mixed together. As a nonlimiting example, elastic fibers may be inserted or woven through an inelastic, flexible matrix. In some cases, rigid, flexible or elastic pieces may be mixed together. Any material may be impregnated, woven, or intermixed with non-Newtonian material 604 according to any method described in this disclosure. In some cases, certain domains of two or more materials may overlap. Such overlap may have any form, including flanges, combinations of grooves and projecting ridges, combinations of recesses and protrusions, teeth, and the like. Additionally, and/or alternatively, such overlap may run the length of an entire element or may run only for a portion thereof. In some cases, combinations of two or more materials may be arranged side-by-side or vertically.

With continued reference to FIG. 6, a material may be considered Newtonian if its rigidity, viscosity, and/or shear resistance is essentially constant under shear rates/shear stress that may occur when such material is used as a component of snow sliding device 100, as described in this disclosure, even if the material may be shown to evince a slight variation in rigidity, viscosity, and/or shear resistance based on shear rate and/or shear stress. If for the purposes of its use in a snow sliding apparatus, the variation in shear resistance is small enough that the relationship between shear rate and shear stress appears linear, with an intercept close to 0, without advanced testing equipment, a material may still be considered Newtonian. Similarly, a material having essentially constant shear resistance across shear rates/shear stresses as measured in use consistent with snow sliding device 100 may be considered a Newtonian material for purposes herein, even if under significantly different temperatures, pressures, or other physical effects the material may be induced to behave in a non-Newtonian manner. As a nonlimiting example, a plastic material that has been melted to the point where it behaves as a liquid may exhibit non-Newtonian responses at low shear rates but may not exhibit non-Newtonian responses when in a solid form; this material would be considered as non-Newtonian, for purposes herein, if the material is in its solid form at pressures and temperatures experienced during its use in snow sliding device 100.

With continued reference to FIG. 6, in one or more embodiments, Newtonian material 608 may include an elastomeric, flexible, or rigid material. For the purposes of this disclosure, an "elastomeric" material is a type of material capable of undergoing significant elastic deformation upon applying a stress and returning to its original shape when the stress is removed. Nonlimiting examples of elastomeric materials may include natural and synthetic rubber as well as many synthetic polymers. For the purposes of this disclosure, a "flexible" material is a material capable of bending or deforming easily without breaking. Nonlimiting examples of flexible materials may include plastics, textiles, fabrics, foams, certain metals such as copper and platinum, fiberglass, carbon fiber composites. For the purposes of this disclosure, a "rigid material" is a material characterized by its high stiffness and minimal deformation under external forces, maintaining its shape and size even when subjected to significant loads. Rigid materials possess a high modulus of elasticity and often exhibit elastic behavior, returning to their original shape after removal of stress. Nonlimiting examples of rigid materials may include metals like steel and titanium, ceramics such as alumina and silicon carbide, and composites like fiber-reinforced polymers.

With continued reference to FIG. 6, non-Newtonian materials or fluids as described herein may belong to one of five general classifications: (1) pseudoplastic or shear-thinning materials or fluids that demonstrate decreased apparent rigidity and/or apparent viscosity in response to an increasing shear rate; (2) dilatant or shear-thickening materials or fluids that demonstrate increased apparent rigidity and/or apparent viscosity in response to an increasing shear rate; (3) thixotropic materials or fluids that demonstrate decreased apparent rigidity and/or apparent viscosity over time under constant shear stress; (4) rheopectic materials or fluids that demonstrate increased apparent rigidity and/or apparent viscosity over time under constant shear stress; and (5) Bingham plastics that act like solids at low shear stresses but flow as viscous fluids at higher shear stresses. Nonlimiting examples of pseudoplastic or shear-thinning materials or fluids may include blood, ketchup, and paints. Nonlimiting examples of dilatant or shear-thickening materials or fluids may include cornstarch in water, some industrial slurries, and synthetic polymers such as polyborodimethylsiloxane, borated siloxane-based materials, and chemical/physical analogs thereof. Nonlimiting examples of thixotropic materials or fluids may include yogurt and certain gels. Nonlimiting examples of rheopectic materials or fluids may include gypsum suspensions. Nonlimiting examples of Bingham plastics may include toothpaste and mayonnaise. Additional nonlimiting examples of non-Newtonian materials or fluids may include certain sauces, dressings, and dairy products, certain lotions, creams, and gels, as well as certain drilling muds, lubricants, and polymer solutions.

With continued reference to FIG. 6, use of non-Newtonian material 604 in first snow sliding device 100 may confer various advantages regarding vibration control. When non-Newtonian material 604 is a dilatant material, higher shear rates induced by higher amplitude oscillations may cause the non-Newtonian material 604 to stiffen further, increasing overall damping of oscillation, and particularly resisting movement of oscillation at points during which oscillation is at peak kinetic energy/velocity; this may damp oscillation to a negligible level far more rapidly for a given quantity of damping material, permitting non-Newtonian material 604 to be used in smaller amounts than conventional damping material. As a result, first snow sliding device 100 may provide a user with a smoother ride by damping or cancelling out vibration or "chatter." Incorporation of non-Newtonian material 604 may permit designers to take advantage of variations in flexibility and stiffness of the non-Newtonian material 604 under different circumstances to achieve two or more performance goals simultaneously. As a nonlimiting example, certain maneuvers may be performed more deftly by a flexible snow sliding device 100, whereas a stiff snow sliding device 100 may be necessary to hold to a course at high velocity or on rougher surfaces; when non-Newtonian material 604 is a dilatant material, non-Newtonian material 604 may be flexible under lower shear rates and stiff under higher shear rates, allowing a combination of expert maneuvers and handling at high velocity that previously was unattainable. Similarly, inclusion of non-Newtonian material 604 in snow sliding device 100 may enable designers or users to achieve a performance goal without sacrificing robustness or durability.

With continued reference to FIG. 6, in some cases, a dilatant material or fluid may behave like low viscosity fluid under small or absent rates/stress but behave as a highly viscous fluid under higher rates/stress. In some cases, a dilatant material may behave as a solid or quasi-solid material when subjected to high shear rates/stress, while behaving as a low-viscosity fluid under low or absent shear rates/stress. In some cases, a dilatant material may behave as flexible or elastomeric solids or quasi-solids when subjected to little or no shear rates/stress, but as highly rigid solids under high shear rates/stress.

With continued reference to FIG. 6, in some cases, the normal or resting condition of non-Newtonian material 604 (i.e., the condition where non-Newtonian material 604 is experiencing low or absent shear rate or shear stress) and the opposite or ending point where the non-Newtonian material 604 is subjected to a high shear rate or shear stress may define the endpoints of a portion of a spectrum; one end of the spectrum may be described as "fluidity," whereas the other may represent "rigidity." Some non-Newtonian materials 604 may cover the entire range of the spectrum, while others may cover only a part thereof. As a nonlimiting example, a non-fluid non-Newtonian material 604 may range from soft, elastic or flexible at one extreme along the spectrum to a rigid solid at the other end but may not arrive at a fluid or apparently fluid form, at least in the temperature range in which it is tested; the non-fluid non-Newtonian material 604 in this example may still be defined as lying on the spectrum, as its softer extreme is closer to a liquid form than its more rigid extreme. In some cases, adjustment of forces that act on non-Newtonian material 604, the types of ingredients in the non-Newtonian material 604, and/or the quantities of ingredients in the non-Newtonian material 604 may shift a window of non-Newtonian behavior toward either the rigid or fluid end of the spectrum or increase (widen) or decrease (narrow) the window within the spectrum with respect to that material. As a nonlimiting example, a dilatant material subjected to a high shear rate may be driven in the direction of rigidity on the spectrum, whereas cessation of the shear stress may drive the material back toward fluidity.

With continued reference to FIG. 6, as movement along the spectrum is affected by shear rate, the timescale over which a shear stress is applied to non-Newtonian material 604 may affect its movement along the spectrum. For instance, a gradually applied shear stress to a dilatant material may result in a small or negligible increase in viscosity or rigidity, while a shear stress applied rapidly may result in a drastic increase in viscosity or rigidity, consistent with details described above. As a nonlimiting example, a dilatant suspension of cornstarch in water, sometimes known as "Oobleck," may support a person stepping rapidly or "dancing" on its surface, while allowing a person who stands or walks slowly on the surface to sink into the material; the opposite effect is observed in water-impregnated "quicksand," which demonstrates pseudoplastic properties, causing a swimmer trapped in the quicksand to sink faster when struggling harder. Timescale limits under which non-Newtonian behavior is observable may depend upon various factors, including characteristics of a force applied to the material, and the type of non-Newtonian material 604 involved.

With continued reference to FIG. 6, non-Newtonian materials 604 may be modeled according to a "power law," wherein the viscosity of the non-Newtonian materials 604 is characterized by the equation $\eta=K\dot{\gamma}^{n-1}$, where $\eta$ is the viscosity of the material as described above, K is a positive material-specific constant, and $\dot{\gamma}$ is the applied shear rate as described above. When n is less than 1, the material represented in the equation is pseudoplastic, and the viscosity of the material, $\eta$, is proportional to a negative power of the applied shear rate, $\dot{\gamma}$. When n is greater than 1, the material represented in the equation is dilatant, and the viscosity of the material is proportional to a positive power of the applied shear rate, $\dot{\gamma}$. It is worth noting that the positive power may be a non-constant positive power; that is, the positive power may be approximately constant or may vary while still exceeding zero. As a nonlimiting example, (n−1) may vary between 0.5 and 3, but remain greater than zero, and still be considered a positive power for the purposes herein. Similar variations may be observed with regard to negative powers as well. A person of ordinary skill in the art, upon reviewing the entirety of this disclosure, will also be aware that properties of a material may often be described by a single equation only within a limited range of parameters, and that a property described for a material is described for the material as subjected to parameters of its typical use; thus, for instance, a dilatant material used in snow sliding device 100 is a material exhibiting shear-thickening behavior within the range of temperatures and forces to which that form of snow sliding device 100 is subjected during its intended use, i.e., during motion navigation through the range of forces and impacts presented by bodies of snow. Similarly, a material described as elastic is a material that behaves in an elastic manner within the intended range of temperatures and forces, and. As a nonlimiting example, such elastic material may become rigid at very low temperatures, fluid at very high temperatures, and unable to rebound from excessive forces.

With continued reference to FIG. 6, various mechanisms may cause dilatant behavior in a material, independently or in combination. In shear-induced ordering, alignment of particles in a dilatant material may increase as a shear stress is applied; increasingly aligned particles may behave in an increasingly rigid manner. Additionally, and/or alternatively, particles within a dilatant material may be ordered at low shear rates, and become increasingly disordered at higher shear rates, resulting in greater rigidity, viscosity, and/or shear resistance. Another factor which may contribute to dilatant behavior may be a change in volume of one or more ingredients, such as molecules whose volume expands under shear stress; this increase in volume may increase rigidity, viscosity, and/or shear resistance of a dilatant material.

Another factor which may increase rigidity, viscosity, and/or shear resistance in a dilatant material may be friction between particles that increases with increased shear rate, inhibiting movement of particles past each other. An additional factor that may increase rigidity, viscosity, and/or shear resistance with increased shear rate may be an attraction between molecules that increases upon application of shear stress. Another factor that may cause dilatant behavior may be a shear stress overcoming repulsive forces between particles, allowing them to clump together. In suspensions of particles in liquids or gels, increases in shear rate may cause micro assembly of clusters that increases shear resistance and viscosity.

With continued reference to FIG. 6, an additional factor that may cause dilatant behavior may be observed in certain polymeric materials, wherein shear-induced crosslinking between molecular elements may increase viscosity and/or shear resistance. Another factor that may contribute to dilatant behavior may be the formation of shear-induced non-Gauss chains in polymeric materials. An additional factor that may contribute to dilatant behavior in polymeric materials may be a formation of space network structure in response to increases in shear rates. It should be understood that the above list of interactions and mechanisms is not intended to be exhaustive, and that dilatant/shear-thickening behavior may be a result of any phenomenon or interaction, or combination of phenomena or interactions including those listed above and any others, as would be apparent to a person of ordinary skill in the art upon reviewing the entirety of this disclosure.

With continued reference to FIG. 6, in one or more embodiments, decrease in shear rate, for instance by reduction or removal of shear stress, may have the opposite effect in non-Newtonian material 604 compared to an increasing shear rate. As a nonlimiting example, a dilatant material under a high shear stress may be apparently solid or viscous and may become increasingly soft or fluid as the shear stress is reduced or removed. In contrast, as another nonlimiting example, a pseudoplastic material may become increasingly stiff or viscous as a shear stress is reduced or removed.

With continued reference to FIG. 6, several categories of non-Newtonian materials 604 will now be described in further detail. It should be understood that this list is not intended to be exhaustive. Any suitable type or types of non-Newtonian materials or fluids recognized by a person of ordinary skill in the art upon reviewing the entirety of this disclosure may be contemplated for embodiments described in this disclosure. Non-Newtonian materials 604 may include dilatant materials or fluids, as described above. A dilatant material or fluid may possess the characteristics of a fluid until it encounters a shear stress, whereupon the dilatant material or fluid will thicken (e.g., move toward rigidity) and behave more like a higher-viscosity fluid, quasi-solid, or solid. Shear stress may be supplied by any suitable form of agitation, including without limitation direct or indirect impact of an object against a dilatant fluid. A dilatant fluid may return to a lower-viscosity or more liquid state upon cessation or reduction of shear stress. In some cases, a dilatant material or fluid may include a colloid with nanoparticles or microparticles suspended in a liquid medium. Any suitable medium or particles may be used for such cases. A nonlimiting example of a colloid-based dilatant material or fluid may include silica particles suspended in polyethylene glycol. In the absence of shear stress, or when being acted on by a gradually applied shear stress, these particles may float freely in the liquid medium without clumping or settling, owing to a slight mutual repulsion between the particles. An increase in shear rate, for instance due to a sudden impact, may overcome such repulsion, allowing particles to clump together, resulting in an increase in rigidity, viscosity, or apparently solid properties. When shear rate decreases, repulsion may dominate to disassemble to these clumps, causing particles to re-adopt fluid-like behaviors. Dilatant fluids may be used to make films, resins, finishes, and coatings that exhibit dilatant behavior. A Person of ordinary skill in the art, upon reviewing the entirety of this disclosure, will be familiar with methods used to make films, finishes, and coatings using dilatant fluids.

With continued reference to FIG. 6, conversely, a pseudoplastic fluid may possess the characteristics of a higher-viscosity fluid, solid, or quasi-solid until it encounters a shear stress, whereupon the pseudoplastic fluid will thin (e.g., move away from rigidity) and behave more like a lower-viscosity fluid or a softer solid or quasi-solid. These types of non-Newtonian fluids may be incorporated in adhesives, such as glue or epoxy. A person of ordinary skill in the art, upon reviewing the entirety of this disclosure, will be familiar with methods used to make films, finishes, and coatings using pseudoplastic fluids.

With continued reference to FIG. 6, non-Newtonian materials 604 may include non-Newtonian gels. Non-Newtonian gels may have the characteristics of high-viscosity fluids, quasi-solids, or intermediate forms. Such non-Newtonian gels may have a similar composition to non-Newtonian fluids but may exhibit higher apparent viscosity or rigidity. In one or more embodiments, non-Newtonian may have the same ingredients as non-Newtonian fluids but may exist in a gel form due to one or more of various factors, including additional ingredients or environmental conditions that cause a liquid medium to become gelatinous. Non-Newtonian gels may exhibit similar qualities to jellies, putties, or clays. Non-Newtonian gels may include either dilatant gels or pseudoplastic gels. At low or absent shear rates, dilatant gels may be deformed with application of little or no force, while at higher shear rates such as those resulting from the energy of a sudden impact, dilatant gels may become increasingly rigid, with an improving resistance to deformation. The mechanisms that cause dilatant behavior in other dilatant materials may cause dilatant behavior in dilatant gels. On the other hand, pseudoplastic gels may be rigid at low or absent shear rates/stress, with a strong shear resistance, while at higher shear rates/stress may be more readily deformed. The mechanisms that cause pseudoplastic behavior in other pseudoplastic materials may cause pseudoplastic behavior in pseudoplastic gels.

With continued reference to FIG. 6, non-Newtonian fluids or gels may be encapsulated to produce another non-Newtonian material 604. Encapsulated non-Newtonian fluids or gels may include containers filled with non-Newtonian fluids or gels. Containers may include one or more flexible or rigid walls; the walls may also be constructed wholly or in part of such non-Newtonian material or materials. Containers may be designed to receive vibrations or impact forces and transmit the vibrations or impact forces to the non-Newtonian fluid or gels. The resulting increase/decrease in viscosity, rigidity, or shear resistance of enclosed non-Newtonian fluids or gels may cause the viscosity, rigidity, or shear resistance of containers to also increase/decrease.

With continued reference to FIG. 6, in some cases, non-Newtonian materials 604 may include non-Newtonian foams. Nonlimiting examples of non-Newtonian foams may include dilatant foams and pseudoplastic foams. Non-Newtonian foam may be formed by confining physically or chemically produced bubbles of gas in a non-Newtonian gel or fluid. The resulting material may be solidified. Non-Newtonian foam may have similar behaviors to other non-Newtonian materials. As a nonlimiting example, an increased shear rate caused by a sudden impact or other event may cause a dilatant foam to become more rigid, while under reduced shear rates the dilatant foam may be softer or more flexible, whereas pseudoplastic foams may exhibit an inverse response as described above.

With continued reference to FIG. 6, in some cases, non-Newtonian materials 604 may include non-Newtonian solids. Nonlimiting examples of non-Newtonian solids may include dilatant solids and pseudoplastic solids. Non-Newtonian solids may be produced by solidifying non-Newtonian gels or fluids, or by introducing one or more non-Newtonian materials 604 into solid matrices. Processes such as extrusion or injection molding may be used to prepare non-Newtonian solids. Such non-Newtonian solids may exhibit similar behavior to other non-Newtonian materials 604. As a nonlimiting example, a dilatant solid may be relatively flexible or elastic under lower shear rates but may be more rigid or hard when subjected to high shear rates, such as those resulting from a sudden impact. Similar mechanisms to those causing shear thickening in other dilatant materials may produce shear-thickening behavior in dilatant solids.

With continued reference to FIG. 6, in some cases, non-Newtonian materials 604 may include non-Newtonian filaments. Nonlimiting examples of non-Newtonian filaments may include dilatant filaments. Dilatant filament may be prepared using any suitable processes, or combination of processes, such as without limitation, injection molding, extrusion, or spinning out of a melt. Dilatant filament may exhibit the characteristics of a dilatant solid.

With continued reference to FIG. 6, in some cases, non-Newtonian materials 604 may include non-Newtonian impregnated fibers. As a nonlimiting example, non-Newtonian impregnated fibers may include a fiber or yarn that has absorbed, and/or is coated with, non-Newtonian material 604, such as a dilatant material. Fiber used herein may include a high strength polymeric fiber or the like. Such non-Newtonian impregnated fibers may be a fluid and may retain its fluid characteristics after impregnation. This may help to ensure that non-Newtonian impregnated fibers may remain flexible while exhibiting non-Newtonian properties. Non-Newtonian impregnated fibers and non-Newtonian filaments may be used in combination with or in lieu of any other fiber in any textile, endowing the textile with the non-Newtonian properties of the non-Newtonian impregnated fibers and non-Newtonian filaments, in combination with any additional properties of the textile.

With continued reference to FIG. 6, in some cases, non-Newtonian materials 604 may include reinforced materials containing non-Newtonian impregnated fibers. As nonlimiting examples, reinforced materials may include a fabric that has absorbed, and/or is coated with, a non-Newtonian material 604 such as a dilatant material. Additionally and/or alternatively, reinforced material may include previously impregnated fibers woven together to form a fabric. It is also contemplated that reinforced material may include a fabric made by weaving together non-Newtonian filaments and/or non-Newtonian impregnated fibers. It is further contemplated that such fabric or non-Newtonian impregnated fibers may be set into another medium to reinforce that medium. It is also contemplated that non-Newtonian materials 604 may be mixed in with the medium to impart non-Newtonian properties to the medium. Reinforced material may exhibit non-Newtonian behaviors, similar to those described above with respect to the other categories of non-Newtonian materials 604. As a nonlimiting example, the coefficient of friction between non-Newtonian impregnated fibers, and/or between non-Newtonian impregnated fibers and medium, may increase during an impact event, causing the fibers and/or the medium to become more rigid, resulting in dilatant behavior. It is further contemplated that non-Newtonian impregnated fibers may form a substrate that, upon permeation of dilatant material, holds particles of the dilatant material in place. When an object suddenly strikes reinforced material, dilatant material may immediately thicken or harden, imparting its hardness to an overall construction. The flexibility of overall construction will return upon removal of impact or impact. Similarly, non-Newtonian impregnated fibers of reinforced material incorporating pseudoplastic material may act as a substrate retaining the pseudoplastic material at high shear rates, where the flexibility or elasticity of the reinforced material may increase in response to the high shear rates.

With continued reference to FIG. 6, in some cases, non-Newtonian materials 604 may include non-Newtonian textiles. Non-Newtonian textiles may be formed using any non-Newtonian impregnated fibers, reinforced materials, and/or the like. Non-Newtonian impregnated fibers or fiber-reinforced material may be formed into non-Newtonian textile by any suitable process for combining fibers or fiber-reinforced materials into textiles, including without limitation weaving and matting fibers or fiber-reinforced materials.

With continued reference to FIG. 6, in some cases, non-Newtonian materials 604 may include non-Newtonian composites. As a nonlimiting example, non-Newtonian composites may include a solid foamed synthetic polymer. Solid foamed synthetic polymer may include an elastic and/or an elastomeric matrix, consistent with details described above regarding Newtonian materials 608. Elastomeric matrix may retain its own boundaries without a need for a container. Non-Newtonian composites may also include a polymer-based non-Newtonian material 604 different from solid foamed synthetic polymer. Polymer-based non-Newtonian material 604 may be distributed through matrix and incorporated therein during manufacture. Non-Newtonian composites may also include a fluid distributed through matrix. A combination of matrix, non-Newtonian material 604, and fluid may be selected such that the composite may be resiliently compressible (i.e., capable of displaying resistance to compressive set), and preferably also flexible. As another nonlimiting example, non-Newtonian composite may include a solid, closed cell foam matrix and a polymer-based non-Newtonian material 604 different from and distributed through the matrix. Composite may also include a fluid distributed through matrix. A combination of matrix, non-Newtonian material 604, and fluid may be selected such that the composite may be resiliently compressible. In either of composites described above, any suitable solid materials may be used as matrix, including, for example and without limitation, elastomers. This may include natural elastomers, as well as synthetic elastomers, including synthetic thermoplastic elastomers. These may include elastomeric polyurethanes, silicone rubbers, and ethylene-propylene rubbers. Any polymer-based non-Newtonian material that may be incorporated into the matrix may be used in composites. As a nonlimiting example, a dilatant polymer may be selected from silicone polymer-based materials, such as borated silicone polymers. Non-Newtonian polymer may be combined with other components (i.e., fillers) in addition to components supporting non-Newtonian behaviors, including, for example and without limitation, fillers, plasticizers, colorants, lubricants, and thinners. These fillers may be particulates (including microspheres), fibrous, or a mixture thereof.

With continued reference to FIG. 6, in some cases, non-Newtonian materials 604 may include non-Newtonian layers. Non-Newtonian layers may include one or more layers of material constructed using one or more of the above categories of non-Newtonian materials 604. Non-Newtonian layers may be combined with other layers having other properties, such that the combined layers may exhibit some form of non-Newtonian behavior as a result.

With continued reference to FIG. 6, it is worth noting that the use of the terms "non-Newtonian materials," "pseudoplastic materials," and/or "dilatant materials" in the description of snow sliding devices is meant to cover all categories of non-Newtonian, pseudoplastic, and/or dilatant materials known to a person of ordinary skill in the art upon reviewing the entirety of this disclosure, including without limitation the categories and examples of non-Newtonian, pseudoplastic, and/or dilatant materials described herein.

Figure 7:
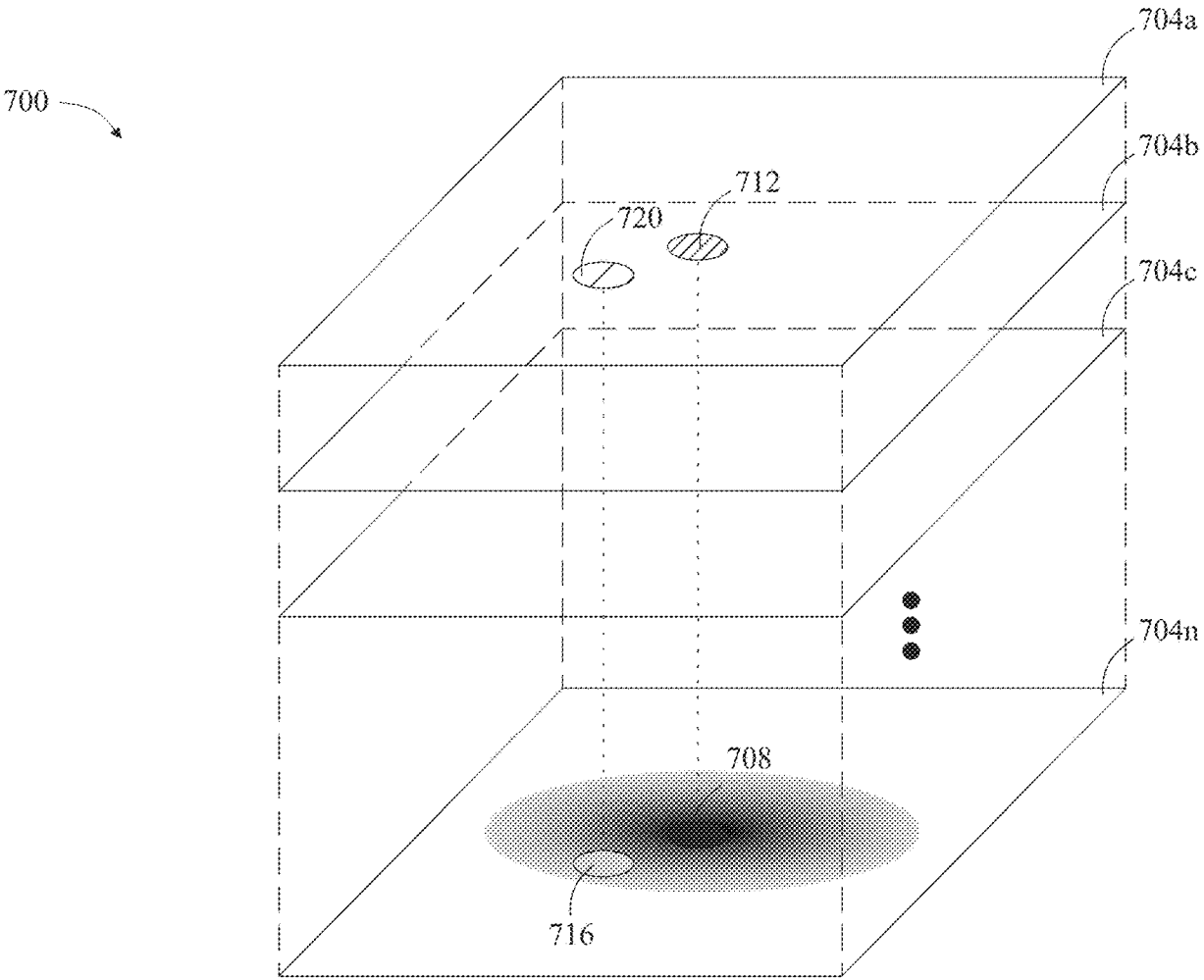
FIG. 7 is a schematic illustration of an exemplary embodiment of at least a constituent of the first snow sliding device.

Referring now to FIG. 7, first snow sliding device 100 includes one or more constituents 700, exemplary embodiments of which are illustrated. At least a constituent 700 of one or more constituents 700 includes at least a non-Newtonian material 604. For the purposes of this disclosure, a "constituent" is a structural and/or functional component used to assemble a device or apparatus. Constituent 700 may include any portion of first snow sliding device 100 and may adopt any size or shape as deemed suitable by a person of ordinary skill in the art upon reviewing the entirety of this disclosure. Constituent 700 may have any three-dimensional (3D) or two-dimensional (2D) form encompassing regular or irregular polygonal, polyhedral, curved, or combined forms. As nonlimiting examples, shape of constituent 700 may include right rectangular prism/right square prism, triangular prism, pentagonal prism, hexagonal prism, parallelepiped, rhombohedron, trigonal trapezohedron, right or oblique circular cylinder, elliptic cylinder, truncated sphere, truncated ellipsoid, or a similar geometry, including one or more variations thereof, that is either flat/substantially flat at its top and bottom or otherwise capable of fitting into a flattened structure of first snow sliding device 100. Constituent 700 may have any suitable size or shape that may complement the size or shape of its neighboring element or elements. In some cases, a plurality of constituents 700 may be arranged in a rectilinear or board-like form. In some cases, constituent 700 may run substantially all the length or breadth of first snow sliding device 100 by following a certain geometric pattern, such as a stripe-like pattern. As a nonlimiting example, constituent 700 may include at least an insert 232 of an elongated shape, such as right rectangular prism/right square prism, triangular prism, right circular prism, or the like. In some other cases, constituent 700 may run less than a full length or breadth of an element. As a nonlimiting example, a plurality of constituents 700 may follow a tessellated pattern, such as a checkerboard-like pattern of rectilinear forms, a pattern of adjacent polygonal forms, curved forms, combinations thereof, or the like. Tessellated patterns may include patterns of identical forms or varied forms. As a nonlimiting example, different sections may have different shapes or sizes that combine to form at least a portion of first snow sliding device 100. In one or more embodiments, at least a constituent 700 may be used in specific locations, as illustrated in further examples below. In some cases, plurality of constituents 700 may be arranged, either with one another or with one or more other elements of first snow sliding device 100, in a staggered brick pattern with ends offset by a prescribed amount to ensure overlap.

With continued reference to FIG. 7, in some cases, constituent 700 may include one or more layers 704*a-n* that may be attached or applied to another layer or plurality of layers to form a single building block with well-defined size and shape. In some cases, one or more constituents 700 may include a plurality of layers 704*a-n* laminated together, wherein at least a constituent 700 is incorporated into at least one layer 704*a-n* of the plurality of layers 704*a-n*. In some cases, constituent 700 may include or be incorporated within one or more inserts 232 configured to seamlessly fit into one or more cavities within first snow sliding device 100. In some cases, at least a constituent 700 may be incorporated into at least a channel 228, as insert 232 or the like, consistent with details described above. In some cases, at least a constituent 700 may be located inside core 200*a-c*, as described above. In some cases, plurality of constituents 700 may be combined to form at least part of core 200*a-c* through processes such as lamination, as described above. In some cases, at least a constituent 700 may be molded, such as by an injection molding process. At least a constituent 700 may be molded and/or processed to form any shape that may enable it to be incorporated in a void, groove, recess, matrix, or the like that's created and configured for its inclusion, as described above. A nonlimiting example of matrix herein may include a honeycomb matrix. Alternatively, or additionally, at least a constituent 700 may be molded in combination with one or more other elements of first snow sliding device 100 that are created by molding, such as without limitation core 200*a-c*, which may include molding the at least a constituent 700 with at least another material making up the core 200*a-c* or molding the core 200*a-c* out of the at least a constituent 700. In some cases, constituent 700 may include one or more flexible elements, such as filaments, fibers, or textiles, that may be integrated with another element of snow sliding device 100. In some cases, constituent 700 may be attached to the rest of first snow sliding device 100 using one or more mechanical fasteners including, but not limited to, screws, nuts and bolts, anchors, clips, welding, brazing, crimping, nails, blind rivets, pull-through rivets, pins, dowels, snap-fits, clamps, and/or the like. In some cases, constituent 700 may be attached to the rest of first snow sliding device 100 using one or more adhesives, such as epoxy adhesives, polyurethane adhesives, polyimide adhesives, superglues such as cyanoacrylate adhesives, or the like. In some cases, one or more constituents 700 may be applied to the rest of first snow sliding device 100 as one or more layers of coating or surface treatment. Additionally, and/or alternatively, at least a constituent 700 may be implemented as pads, solids, fluids, gels, foams, capsules, non-fluid packages, and the like, consistent with details disclosed in U.S. patent application Ser. No. 16/507,229, filed on Jul. 10, 2019, and entitled "SNOW SLIDING DEVICE INCORPORATING MATERIAL HAVING SHEAR-RATE DEPENDENT SHEAR RESISTANCE, AND METHODS FOR ITS MANUFACTURE," the entirety of which is incorporated herein by reference.

With continued reference to FIG. 7, in some cases, constituent 700 may be integrated with the rest of first snow sliding device 100 using one or more sets of mating features. For the purposes of this disclosure, a pair of "mating features" are two sets of complementary geometric structures, i.e., a first mating feature and a second mating feature, that are capable of interlocking with one another to secure a stable connection in between without slipping over one another. First mating feature may include any component of any latching or fastening apparatus and may latch or fasten to second mating feature, and vice versa. In one or more embodiments, first mating feature may form a mortise-and-tenon combination with second mating feature; the mortise-and-tenon combination may include at least a projection and/or recess in first mating feature that is inserted into and/or penetrated by a corresponding recess and/or projection in second mating feature. As a nonlimiting example, first mating feature may include at least a projection, which may be cylindrical or have any other suitable form, that projects from a surface. Alternatively, and/or additionally, in one or more embodiments, other types of mating mechanisms, such as screws, bolts, snap lock mechanisms, twist lock mechanisms, and/or the like may be used. As a nonlimiting example, one or more mating components may include male grooves that are configured to be inserted into one or more receiving female grooves. Groove may include a tongue and groove, a half lap, a rabbet joint, a biscuit joint, a dowel joint, a dado going, an ordinary male groove, and the like. In one or more embodiments, a mating feature may be further divided into a plurality of mating sub-features, and more than one pair of mating sub-features may be implemented between constituent 700 and another element of first snow sliding device 100.

With continued reference to FIG. 7, at least a constituent 700 of one or more constituents 700 transitions between a first composition 708 at a first position 712 and a second composition 716 at a second position 720. In other words, the composition of matter is non-uniform across at least a constituent 700 of one or more constituents 700. Specifically, first composition 708 includes a first proportion of non-Newtonian material 604 mixed with a second proportion of Newtonian material 608, and second composition 716 includes a third proportion of non-Newtonian material 604 mixed with a fourth proportion of Newtonian material 608, and the first proportion is different from the third proportion. For the purposes of this disclosure, a "proportion" is a numerical indicator that describes the abundance of its associated subject matter, according to one or more standards or conventions. A proportion close to 0 indicates a low abundance of a subject matter, whereas a proportion close to 100% or 1 includes a high abundance of the subject matter instead. As a nonlimiting example, a proportion may include a percentage by mass or volume, wherein the sum of all percentages of all components equals 100%. As another nonlimiting example, a proportion may include a mole fraction, wherein the sum of all mole fractions of all components equals 1. Accordingly, first and second proportions add up to 1 or 100%, and third and fourth proportion add up to 1 or 100%. Therefore, when first proportion is different from third proportion, second proportion is also different from fourth proportion. Different depths of shading in FIG. 7 are used to illustrate the relative proportions between non-Newtonian material 604 and Newtonian material 608 as a nonlimiting example.

With continued reference to FIG. 7, non-Newtonian material 604 may include without limitation any type of non-Newtonian material described in this disclosure and/or otherwise recognized by a person of ordinary skill in the art upon reviewing the entirety of this disclosure. As nonlimiting examples, non-Newtonian material 604 may include a dilatant or pseudoplastic material. Similarly, Newtonian material 608 may include without limitation any type of Newtonian material described in this disclosure and/or otherwise recognized by a person of ordinary skill in the art upon reviewing the entirety of this disclosure. As nonlimiting examples, Newtonian material 608 may include an elastomeric, flexible, or rigid/substantially rigid material. Rigid/substantially rigid materials may include without limitation wood, steel, or the like. Flexible materials may include without limitation flexible polymers in block, sheet, or layered forms, textiles, and fiber mat materials, among others. Elastic material may include without limitation elastic polymers such as natural or artificial rubber materials, springs such as metal leaves or coiled springs, and enclosed gases such as closed neoprene cells, among others.

With continued reference to FIG. 7, the rationale behind such design is the difference in design and manufacturing requirements regarding different portions of a snow sliding device. As a nonlimiting example, a ski typically contains at least three sections, a tip section, a middle section, and a tail section, as described above. While tip section and tail section are subject to larger extent of vibration or "chatter," middle section is typically expected to sustain the weight of a user and to have a relatively high torsional rigidity, ensuring a good grip when snow sliding device (e.g., a ski) is tipped on its edge. Accordingly, tip section and tail section may incorporate a higher fraction of non-Newtonian materials 604, particularly at locations that undergo vibrations or "chatters" the most, whereas middle section may be constructed primarily with rigid, durable Newtonian materials 608, with little or no non-Newtonian materials. Additional details will be provided below in this disclosure.

With continued reference to FIG. 7, it is worth noting that first composition 708 and second composition 716 may be designated arbitrarily. As a nonlimiting example, first composition 708 may contain mostly/exclusively Newtonian material 608 and little to no non-Newtonian material 604, whereas second composition 716 may contain a high proportion of non-Newtonian material 604 and a low proportion of Newtonian material 608. As another nonlimiting example, first composition 708 may contain a high proportion of non-Newtonian material 604 and a low proportion of Newtonian material 608, whereas second composition 716 may contain mostly/exclusively Newtonian material 608 and little to no non-Newtonian material 604. Additionally, transition between first composition 708 at first position 712 and second composition 716 at second position 720 may follow any type of continuous or apparently continuous gradient or mathematical function deemed suitable by a person of ordinary skill in the art upon reviewing the entirety of this disclosure. As a nonlimiting example, proportion of Newtonian material 608 may be the highest along a longitudinal axis and/or a lateral axis and decay towards the edges of constituent 700. As another nonlimiting example, proportion of Newtonian material 608 may be the highest at the center of constituent 700 and decay radially outward. As another nonlimiting example, proportion of non-Newtonian material 604 may be the highest at a plurality of locations and decay radially outward from each of the plurality of locations. Compared to other possible designs with non-Newtonian materials 604 located in discreet domains or locations across a snow sliding device, the design proposed by current disclosure may allow for a smoother transition from one element to another within the snow sliding device to minimize strain therebetween and avoid breaks during operation.

With continued reference to FIG. 7, in one or more embodiments, the transition between first composition 708 and second composition 716 may be controlled by varying the ratio between a first stream containing the first composition 708 and a second stream containing the second composition 716 using stereolithography (SLA). For the purposes of this disclosure, "stereolithography (SLA)" is an additive manufacturing technology used to create complex three-dimensional objects layer by layer. This technology is known for its precision and ability to produce high-resolution prototypes and functional parts. SLA typically involves curing layers of liquid photopolymer resin with ultraviolet (UV) light. Specifically, in some cases, SLA may include creating a 3D model using computer-aided design (CAD), slicing the 3D model into thin layers, and selectively curing liquid photopolymer resin layer by layer using a UV laser or digital light processing (DLP) projector. Printed object undergoes post-processing to remove excess resin and support structures, followed by additional UV curing and finishing to achieve the desired properties. SLA is widely used in prototyping, medical devices, jewelry, engineering, and consumer products due to its high precision and ability to produce intricate and detailed parts. SLA is commonly known as a type of 3D printing.

With continued reference to FIG. 7, in one or more embodiments, at least a securing element of plurality of securing elements may also include at least a non-Newtonian material 604, consistent with details described above. In one or more embodiments, at least a securing element of plurality of securing elements may include at least a constituent 700, as described above.

Figure 8:
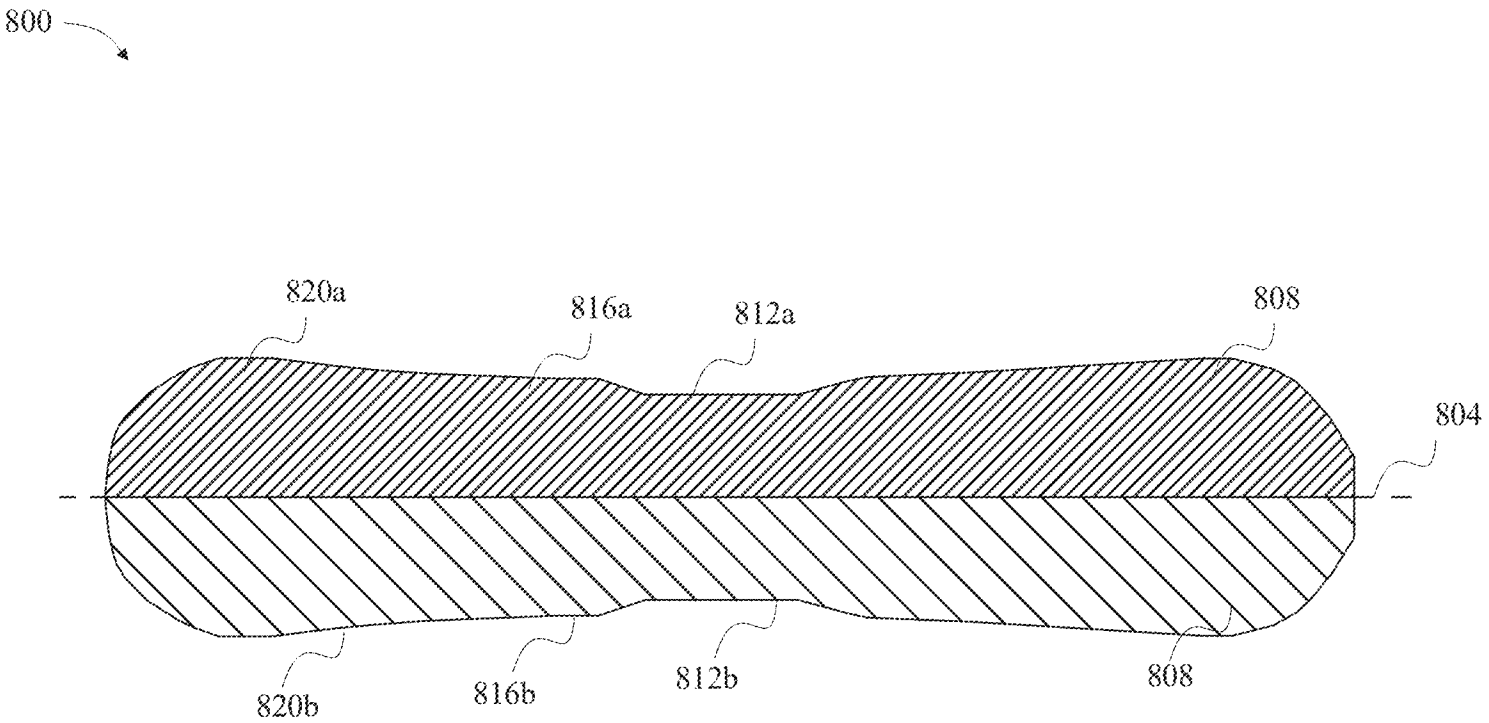
FIG. 8 is a schematic illustration of an exemplary embodiment of a second snow sliding device.

Referring now to FIG. 8, an exemplary embodiment of a second snow sliding device 100 is illustrated. Second snow sliding device includes an elongated core 200*a-c* with a span 804 and a plurality of flanks 808 disposed along the span 804. For the purposes of this disclosure, a "span" is a distance that extends between the two most distant extremes of an elongated object. In the case of second snow sliding device 100, such as a ski or a snow board, span 804 may be a distance that extends from the tip to the tail of the second snow sliding device 100. For the purposes of this disclosure, a "flank" is a peripheral portion of a flat or substantially flat object with respect to its center or central axis. Plurality of flanks 808 includes at least a non-Newtonian material 604. In the case of second snow sliding device 100, there may be a left flank 808 joined with a right flank 808 along span 804, or a plurality of left flanks 808 joined with a matching plurality of right flanks 808 along the span 804. In some cases, two or more flanks 808 of plurality of flanks 808 may be constructed separately and subsequently fused using mechanical fastenings, adhesives, and/or the like, consistent with details described above. In some cases, two or more flanks 808 of plurality of flanks 808 may be constructed in a single piece using methods such as injection molding.

With continued reference to FIG. 8, second snow sliding device 100 includes an asymmetrical distribution of composition of matter. Specifically, a first flank 808 of plurality of flanks 808 includes at least a first composition 708, a second flank 808 of the plurality of flanks 808 includes at least a second composition 716, and the at least a first composition 708 is different from the at least a second composition 716. In some cases, second snow sliding device 100 may include an asymmetrical distribution of at least a non-Newtonian material 604. Accordingly, in such cases, since proportions of non-Newtonian material(s) and Newtonian material(s) add up to 1 or 100%, second snow sliding device 100 may also include an asymmetrical distribution of at least a Newtonian material.

With continued reference to FIG. 8, in one or more embodiments, asymmetrical distribution of composition of matter within second snow sliding device 100 may be reflected in several physical and/or mechanical parameters. As a nonlimiting example, first flank 808 may include at least a first portion with a first Young's modulus 812*a*, second flank 808 may be located opposite the at least a first portion, along span 804, and include at least a second portion with a second Young's modulus 812*b*, wherein the first Young's modulus 812*a* is different from the second Young's modulus 812*b*. For the purposes of this disclosure, "Young's modulus" or "elastic modulus" a measure of a material's stiffness expressed as a ratio between tensile stress and tensile strain within the linear elastic region of a stress-strain curve. Young's modulus may be represented by $E=\sigma/\in$, wherein $\sigma$ is the applied stress and E is the corresponding strain. A higher Young's modulus may signify a stiffer material, whereas a lower Young's modulus may indicate greater flexibility. Young's modulus indicates how much a material will deform under a given load. The SI unit for Young's modulus is Pascal (Pa), with values commonly expressed in gigapascals (GPa). Young's modulus is a commonly used parameter in engineering, material science, and construction for selecting appropriate materials and ensuring structural integrity. Exemplary Young's modulus may include ~210 GPa for steel, a stiff material, and 0.2-1 GPa for polyethylene, a flexible material.

With continued reference to FIG. 8, as another nonlimiting example, first flank 808 may include at least a first portion with a first density 816*a*, second flank 808 may be located opposite the at least a first portion, along span 804, and include a at least a second portion with at a second density 816*b*, wherein the first density 816*a* may be different from the second density 816*b*. Similarly, as another nonlimiting example, first flank 808 may include a first weight 820*a*, second flank may include a second weight 820*b*, wherein the first weight 820*a* may be different from the second weight 820*b*.

With continued reference to FIG. 8, in some cases, second snow sliding device 100 may include an asymmetrical shape. Such asymmetry may be particularly relevant when designing a snowboard. A snowboard is often operated differently from skis. Unlike skiers, whose bodies face directly down the mountain, snowboarders stand sideways with either the right shoulder or the left shoulder dictating where to go. This means that left and right turns are no longer mirror images of each other but utilize different mechanics depending on which direction a snowboarder is turning toward: toe side or heel side. Accordingly, a snowboard may differ in certain design aspects between its toe side and its heel side, resulting in an asymmetrical sidecut, an asymmetrical flex, and/or the like. For the purposes of this disclosure, a "side cut" is the radius of the arc that makes up a snowboard's edge. A shallow sidecut may allow for big, mellow turns that follow a wide arc, while a deep sidecut may allow for quick initiation of short precise turns. An asymmetrical snowboard utilizes both, with a toe side sporting a shallow sidecut and a heel side utilizing a deeper sidecut. For the purposes of this disclosure, a "flex" is a measure regarding how easy or how hard it is to bend a snowboard. On a standard snowboard, its core may be characterized by a single flex rating from soft to hard. In contrast, on an asymmetrical snowboard, there may be a distinct difference between the flex of toe side and that of heel side, with the heel side typically being softer. Such asymmetrical design may compensate for the natural discrepancy between heel and toe and make it easier to initiate heel-side turns while applying less force. A person of ordinary skill in the art may recognize how asymmetrical shapes may be applied for second snow sliding device 100 upon reviewing the entirety of this disclosure.

With continued reference to FIG. 8, second snow sliding device 100 includes plurality of securing elements, including base 304 with sliding surface, top surface 320, and at least a sidewall 404*a-b*, consistent with details described above regarding first snow sliding device 100. In one or more embodiments, plurality of securing elements may further include at least a reinforcement element 400*a-c*, consistent with details described above regarding first snow sliding device. In some cases, at least a reinforcement element 400*a-c* may include one or more layers of textile, one or more layers of aluminum textured with titanium, one or more layers of carbon fiber, one or more layers of graphene, and/or the like. In some cases, second snow sliding device 100 may include one or more additional items, such as one or more buffering elements 316, one or more metal edges 308, among others.

Figure 9:
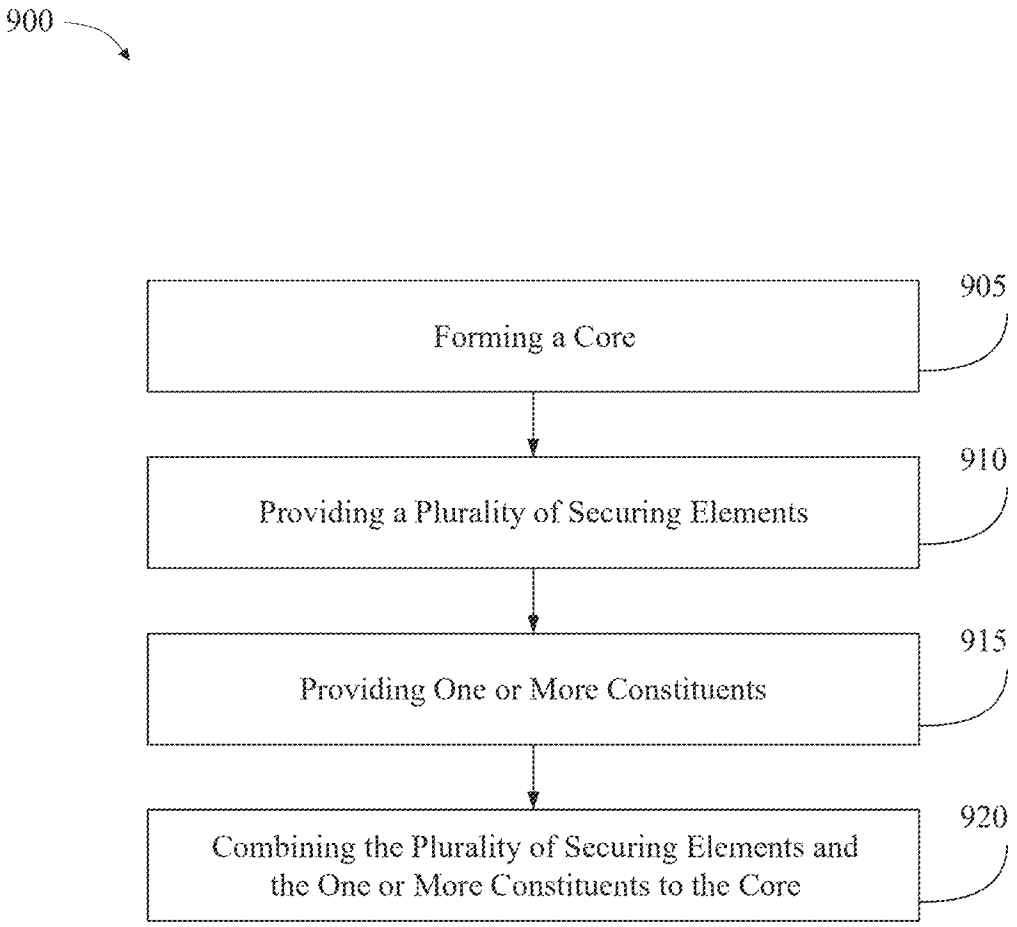
FIG. 9 is a flow diagram of an exemplary embodiment of a first method for manufacturing the first snow sliding device.

Referring now to FIG. 9, an exemplary embodiment of a first method 900 for manufacturing first snow sliding device 100 is described. At step 905, first method 900 includes forming core 200*a-c*. This step may be implemented with reference to details described above in this disclosure and without limitation.

With continued reference to FIG. 9, at step 910, first method 900 includes providing plurality of securing elements, wherein the plurality of securing elements includes a base with a sliding surface, a top surface, and at least a sidewall. This step may be implemented with reference to details described above in this disclosure and without limitation.

With continued reference to FIG. 9, at step 915, first method 900 includes providing one or more constituents 700, wherein at least a constituent 700 of the one or more constituents 700 transitions between a first composition 708 at a first position 712 and a second composition 716 at a second position 720, the first composition 708 includes a first proportion of a non-Newtonian material 604 mixed with a second proportion of Newtonian material 608, the second composition 716 includes a third proportion of the non-Newtonian material 604 mixed with a fourth proportion of the Newtonian material 608, and the first proportion is different from the third proportion. This step may be implemented with reference to details described above in this disclosure and without limitation.

Figure 10:
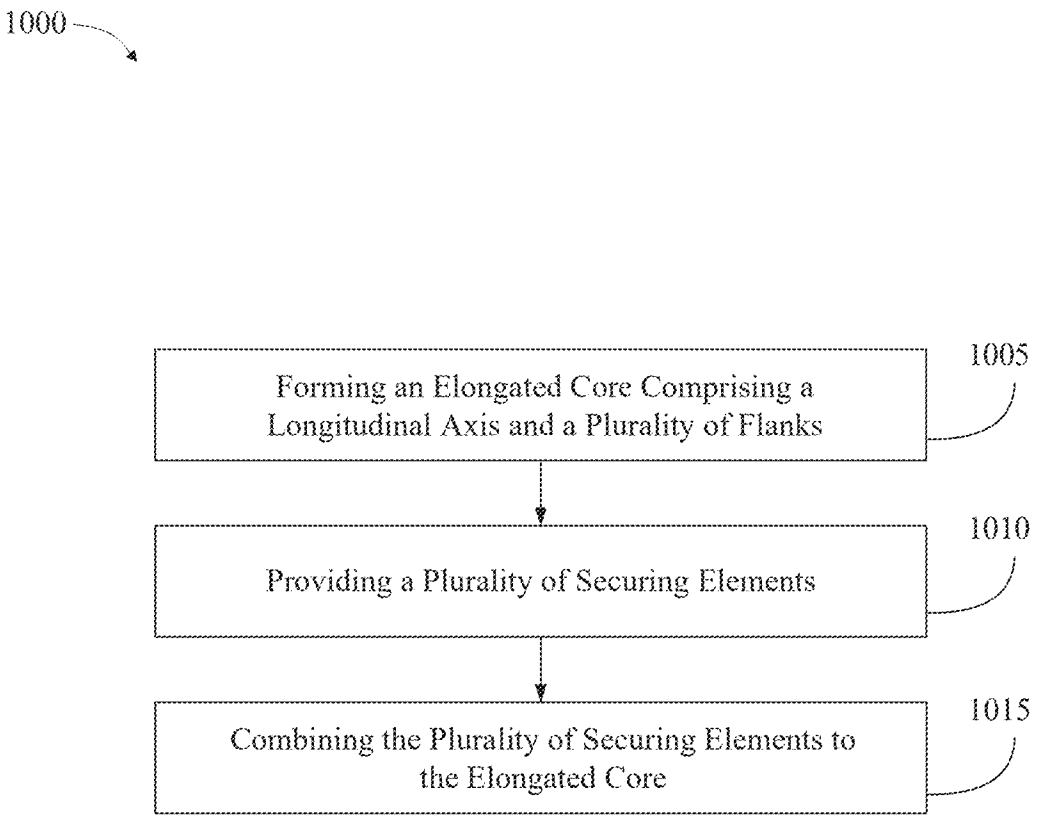
FIG. 10 is a flow diagram of an exemplary embodiment of a second method for manufacturing the second snow sliding device.

Referring now to FIG. 10, an exemplary embodiment of a second method 1000 for manufacturing second snow sliding device 100 is described. At step 1005, method 1000 includes forming elongated core 200*a-c* including span 804 and plurality of flanks 808 disposed along the span 804, wherein first flank 808 of the plurality of flanks 808 includes at least a non-Newtonian material 604 and first composition 708, second flank 808 of the plurality of flanks 808 includes the at least a non-Newtonian material 604 and second composition 716, and the first composition 708 is different from the second composition 716. This step may be implemented with reference to details described above in this disclosure and without limitation.

With continued reference to FIG. 10, at step 1010, second method 1000 includes providing plurality of securing elements, wherein the plurality of securing elements includes base 304 with sliding surface, top surface 320, and at least a sidewall 404*a-b*. This step may be implemented with reference to details described above in this disclosure and without limitation.

With continued reference to FIG. 10, at step 1015, second method 1000 includes plurality of securing elements to elongated core 200*a-c*. This step may be implemented with reference to details described above in this disclosure and without limitation.

It is worth noting that designation of first snow sliding device 100, second snow sliding device 100, first method 900, and second method 1000 may be arbitrary in order to demonstrate various embodiments and aspects of the invention described in this disclosure. The features described for first snow sliding device 100, if applicable, may also apply to second snow sliding device 100, and vice versa. Similarly, first method 900 for manufacturing first snow sliding device 100, if applicable, may also apply to second method 1000 for manufacturing second snow sliding device 100.

Elements of snow sliding device 100 described in this disclosure, such as core 200*a-c*, securing elements, and/or one or more constituents 700, among others may be sourced from a third party, manufactured using any suitable manufacturing method described above, provided using a combination thereof, or otherwise obtained via means deemed suitable by a person of ordinary skill in the art upon reviewing the entirety of this disclosure.

The foregoing has been a detailed description of illustrative embodiments of the invention. Various modifications and additions can be made without departing from the spirit and scope of this invention. Features of each of the various embodiments described above may be combined with features of other described embodiments as appropriate in order to provide a multiplicity of feature combinations in associated new embodiments. Furthermore, while the foregoing describes a number of separate embodiments, what has been described herein is merely illustrative of the application of the principles of the present invention. Additionally, although particular methods herein may be illustrated and/or described as being performed in a specific order, the ordering is highly variable within ordinary skill to achieve methods, systems, and software according to the present disclosure. Accordingly, this description is meant to be taken only by way of example, and not to otherwise limit the scope of this invention.

Exemplary embodiments have been disclosed above and illustrated in the accompanying drawings. It will be understood by those skilled in the art that various changes, omissions and additions may be made to that which is specifically disclosed herein without departing from the spirit and scope of the present invention.

What is claimed is:

1. A snow sliding device comprising:

a core;

a plurality of securing elements comprising:

a base comprising a sliding surface;

a top surface; and at least a sidewall; and one or more constituents, wherein:

at least a constituent of the one or more constituents transitions between a first composition at a first position and a second composition at a second position;

the first composition comprises a first proportion of a non-Newtonian material mixed with a second proportion of a Newtonian material;

the second composition comprises a third proportion of the non-Newtonian material mixed with a fourth proportion of the Newtonian material; and the first proportion is different from the third proportion.

2. The snow sliding device of claim 1, wherein:

the core comprises at least a channel; and the at least a constituent is incorporated into the at least a channel.

3. The snow sliding device of claim 1, wherein at least a securing element of the plurality of securing elements comprises the at least a non-Newtonian material.

4. The snow sliding device of claim 1, wherein at least a securing element of the plurality of securing elements comprises the at least a constituent.

5. The snow sliding device of claim 1, wherein:
the one or more constituents comprise a plurality of layers laminated together; and
the at least a constituent is incorporated into at least one layer of the plurality of layers.

6. The snow sliding device of claim 1, wherein the transition between the first composition and the second composition is controlled by varying a ratio between a first stream containing the first composition and a second stream containing the second composition using stereolithography (SLA).

7. The snow sliding device of claim 1, wherein the non-Newtonian material comprises a dilatant material.

8. The snow sliding device of claim 1, wherein the Newtonian material comprises an elastomeric material.

9. The snow sliding device of claim 1, further comprising at least a first void configured to damp at least an antinode of a vibration.

10. The snow sliding device of claim 1, wherein the plurality of securing elements further comprises at least a reinforcement element.

11. The snow sliding device of claim 10, wherein the at least a reinforcement element comprises one or more members selected from a list consisting of at least a layer of textile, at least a layer of aluminum textured with titanium, at least a layer of carbon fiber, and at least a layer of graphene.

12. The snow sliding device of claim 1, further comprising at least a buffering element sandwiched between the core and at least a securing element of the plurality of securing elements.

13. The snow sliding device of claim 12, wherein the at least a buffering element comprises at least a second void.

14. The snow sliding device of claim 1, further comprising at least an end spacer located adjacent to a terminal surface of the core.

15. A snow sliding device comprising:
an elongated core comprising a plurality of flanks disposed across a longitudinal axis of the elongated core, wherein:
a first flank of the plurality of flanks comprises at least a non-Newtonian material and a first composition;
a second flank of the plurality of flanks comprises the at least a non-Newtonian material and a second composition; and
the first composition is different from the second composition; and
a plurality of securing elements comprising:
a base comprising a sliding surface;
a top surface; and
at least a sidewall.

16. The snow sliding device of claim 15, wherein:
the first flank comprises at least a first portion with a first Young's modulus;
the second flank comprises at least a second portion with a second Young's modulus;
the at least a second portion is located opposite the at least a first portion across the longitudinal axis; and
the first Young's modulus is different from the second Young's modulus.

17. The snow sliding device of claim 15, wherein:
the first flank comprises at least a first portion with a first density;
the second flank comprises at least a second portion with at a second density;
the at least a second portion is located opposite the at least a first portion across the longitudinal axis; and
the first density is different from the second density.

18. The snow sliding device of claim 15, wherein:
the first flank comprises a first weight;
the second flank comprises a second weight; and
the first weight is different from the second weight.

19. The snow sliding device of claim 15, wherein the plurality of securing elements further comprises at least a reinforcement element.

20. The snow sliding device of claim 19, wherein the at least a reinforcement element comprises one or more members selected from a list consisting of a layer of textile, a layer of aluminum textured with titanium, a layer of carbon fiber, and a layer of graphene.

21. A method of manufacturing a snow sliding device, the method comprising:
forming a core;
providing a plurality of securing elements, wherein the plurality of securing elements comprises:
a base comprising a sliding surface;
a top surface; and
at least a sidewall; and
providing one or more constituents, wherein:
at least a constituent of the one or more constituents transitions between a first composition at a first position and a second composition at a second position;
the first composition comprises a first proportion of a non-Newtonian material mixed with a second proportion of a Newtonian material;
the second composition comprises a third proportion of the non-Newtonian material mixed with a fourth proportion of the Newtonian material; and
the first proportion is different from the third proportion,
combining the plurality of securing elements and the one or more constituents to the core.

22. A method of manufacturing a snow sliding device, the method comprising:
forming an elongated core comprising a longitudinal axis and a plurality of flanks disposed across the longitudinal axis, wherein:
a first flank of the plurality of flanks comprises at least a non-Newtonian material and a first composition;
a second flank of the plurality of flanks comprises the at least a non-Newtonian material and a second composition; and
the first composition is different from the second composition;
providing a plurality of securing elements, wherein the plurality of securing elements comprises:
a base comprising a sliding surface;
a top surface; and
at least a sidewall; and
combining the plurality of securing elements to the elongated core.

* * * * *